US009227281B1

(12) United States Patent
Meadows

(10) Patent No.: US 9,227,281 B1
(45) Date of Patent: Jan. 5, 2016

(54) CORELESS PAPER ROLL SUPPORT APPARATUS AND METHOD OF USING

(71) Applicant: Thomas J. Meadows, Leesport, PA (US)

(72) Inventor: Thomas J. Meadows, Leesport, PA (US)

( * ) Notice: Subject to any disclaimer, the term of this patent is extended or adjusted under 35 U.S.C. 154(b) by 0 days.

(21) Appl. No.: 14/570,446

(22) Filed: Dec. 15, 2014

Related U.S. Application Data

(63) Continuation-in-part of application No. 13/691,277, filed on Dec. 6, 2012, now abandoned.

(60) Provisional application No. 61/604,277, filed on Feb. 28, 2012.

(51) Int. Cl.
*B23P 19/04* (2006.01)

(52) U.S. Cl.
CPC ..... *B23P 19/04* (2013.01)

(58) Field of Classification Search
CPC ..... B25B 27/14; B25B 27/10; B25B 27/00; B25B 3/00; B23P 19/10; B23P 19/12; B65H 2701/131; B29C 44/18
See application file for complete search history.

(56) References Cited

U.S. PATENT DOCUMENTS

| | | | | |
|---|---|---|---|---|
| 3,567,085 | A * | 3/1971 | Flores | 224/604 |
| 3,923,181 | A * | 12/1975 | Libit | 215/224 |
| 5,451,013 | A * | 9/1995 | Schutz | 242/597.4 |
| 5,535,962 | A * | 7/1996 | Bargowski | 242/594.3 |
| 6,467,717 | B1 * | 10/2002 | Pedicano et al. | 242/422.5 |
| 7,416,153 | B1 * | 8/2008 | Dervin | 242/599.1 |
| 2002/0017572 | A1 * | 2/2002 | Dobler et al. | 239/34 |
| 2008/0164369 | A1 * | 7/2008 | Adelakun | 242/579 |
| 2011/0315715 | A1 * | 12/2011 | Ophardt | 222/192 |
| 2012/0087741 | A1 * | 4/2012 | Desmeules | 405/251 |

* cited by examiner

*Primary Examiner* — Lee D Wilson
(74) *Attorney, Agent, or Firm* — Clinton H. Wilkinson; Charles A. Wilkinson

(57) ABSTRACT

A tool for mounting a coreless roll of flexible sheet material on a replacement core apparatus including a replacement core and an insertion aid having a polygonal outer end and a base having a profile that matches the profile of outer surface of the replacement core, the replacement core in an embodiment having an enlarged lip member on at least one end, whereby the insertion aid is dimensioned such that it fits over the enlarged lip member enabling the replacement core to be inserted into a central aperture of a coreless roll with the end having the enlarged lip member passing through the center aperture, and in another embodiment the insertion aid having a crenulated tapered section that transitions the outer surface from a polygonal shape to a circular shape to match the cross section of the at least one lip member or outer surface of the replacement core.

14 Claims, 12 Drawing Sheets

CORELESS PAPER ROLL SUPPORT APPARATUS AND METHOD OF USING

CROSS REFERENCE TO RELATED APPLICATIONS

This application claims the benefit of U.S. Provisional Application No. 61/604,227 filed Feb. 28, 2012, and U.S. Nonprovisional Application No. 13,691,277 filed Dec. 6, 2012, the entire contents of which are hereby incorporated by reference.

FIELD OF THE INVENTION

The present invention relates to the dispensing of rolled paper materials and products that are tube free or coreless, and more particularly relates to a reusable core replacement device and method of use for dispensing of tube free or coreless rolled paper materials such as bathroom tissue paper, paper towels and the like.

BACKGROUND OF THE INVENTION

Both consumer and commercial packages of paper material such as bathroom tissue or toilet paper and paper towels are typically provided in a long web or sheet having lines of perforation at regular or semi-regular intervals which divide the long sheet into a plurality of smaller sheets that can be easily separated and used individually or in small sections or aggregations. These sheets have traditionally been prepared in rolls which are wound upon a tubular or cylindrical inner core member made from cardboard or other suitable material. The rolls are conveniently supported during use on a rotatable spindle which is inserted through the cardboard core and then attached to a holder device, or other types of holders such as a stationary chrome plated rod can be used. The inner core member has a regular or even inner surface on which the roll can be rotated on the spindle or other holder to dispense the perforated sheets of paper one or several at a time for use as needed.

Recently, there has been a growing trend towards elimination of inner cores or tubes from bathroom tissue and paper towel rolls. This trend is being furthered by environmental groups who view the elimination of cardboard inner cores or tubes as a green or environmentally friendly way to save paper and help prevent unnecessary destruction of forests. It is estimated by one paper company that 17 billion cardboard toilet paper tubes are produced yearly in the United States, which accounts for approximately 160,000,000 pounds of trash. Elimination of the inner cores also presumably saves manufacturers costs in purchasing the cardboard tubes and gluing the paper to the tube or about the tube.

Although paper rolls can be wound so tightly that the center hole is virtually eliminated, most consumer packaged coreless paper roll products are wound more loosely so that a central hole or aperture is still defined by the innermost convolutions of paper, which center hole may be somewhat smaller than traditional cored rolls but is still large enough to receive a conventional spindle or other support to hold and dispense the paper. During packaging and/or shipping, the paper rolls are packed and compressed very tightly together. While such tight packaging eliminates the empty space in the central hole, and therefore substantially increases shipping efficiency, a drawback of compressing the rolls is that numerous folds or indentations are formed in the walls of the center hole. As a result, when a roll is removed for use the center hole is no longer circular, and is often permanently deformed.

Prior to inserting and passing a paper holder spindle or other support through the center hole, one therefore must manually or with the aid of a small tool manipulate the roll to try to open the compressed center hole and form it into an at least somewhat circular shape, which is difficult and time consuming. Unfortunately, due to the permanent creases and indentations in the crushed paper roll material, it is nearly impossible to make the center hole or orifice substantially round again, so that when the deformed roll is placed on and supported by a spindle, as the individual sheets are dispensed the roll will tend to unroll in a bumpy or uneven fashion. In addition, upon passing the spindle into and through the raggedy center hole, it is very easy to tear and essentially render useless the innermost layers of the roll, particularly if a standard spindle, which are known to have one or more sharp edges that will easily catch and tear the soft, delicate paper material, is used. While paper towels are more durable, the standard width from end to end of a paper towel roll is more than twice that of standard bathroom tissue, which increases the opportunity for tearing as a holder is passed into the center hole. This can lead to a substantial waste of paper in each roll, particularly in the aggregate, not to mention causing substantial distress to consumers, thus offsetting the advantages of coreless rolls and decreasing their attractiveness to consumers.

Recognizing the problems associated with the provision and use of coreless or tubeless rolled paper materials such as bathroom tissue and paper towels by consumers, the present inventor provides a coreless paper roll core replacement tool and method of use that can be used to quickly and easily expand the center hole of even moderate and severely crushed coreless rolls and mount the rolls on a reusable core apparatus without tearing or damaging the innermost convolutions of paper, essentially replacing the conventional paper roll inner core. Once the reusable core apparatus is inserted through the center hole, a spindle or other conventional paper holder can then be passed through the center of the core apparatus. By using the inventor's core replacement tool, sheets of paper material can be dispensed from the roll with the roll turning on a spindle against the smooth even inner surface of the support apparatus rather than the jagged and uneven center hole of the paper roll. That the replacement core is reusable eliminates all of the drawbacks of coreless paper rolls without adding any further waste or requiring new types of paper holders, and in at least one embodiment can also be used equally with rolls having an inner core.

U.S. Pat. No. 5,281,386 issued to L. E. Weinert discloses a method of forming a central aperture in a coreless paper roll, but does not address the problem of using the roll after the central aperture is crushed during packaging and shipping.

U.S. Pat. No. 5,467,935 issued to J. R. Moody discloses a paper roll support spindle apparatus having inner and outer spindle members, and a tab that projects outwardly from the outer spindle and engages with a spindle mounting element when the roll is turned, preventing more than the desired amount of bathroom tissue from unwinding from the roll. Moody assumes the outer surface of the spindle is pressed tightly against the coreless roll central aperture, but does not address the problem of passing the spindle into the aperture without tearing the innermost convolutions of the paper.

U.S. Pat. No. 5,848,762 issued to H. A. Reinheimer et al. discloses a semicylindrical adapter or receptacle onto which a coreless roll is placed and supported as it is turned to dispense the product. The adapter is secured to a conventional paper roll mounting device, thus providing a different solution to mounting coreless rolls.

U.S. Pat. No. 6,360,985 issued to S. L. Phelps et al. discloses an auxiliary holder by which a conventional holder for cored rolls is converted to hold coreless rolls. Phelps provides a mounting structure having an attachment means comprising a pair of rounded knobs that penetrate into depressed areas in the ends of the roll. The Phelps et al. holder is designed for use with commercial paper roll products or those where the paper is wound so tightly that a conventional spindle cannot be passed through the center of the roll, which is not the case with most consumer paper roll products.

U.S. Patent Application Publication 2011/0210199 filed by J. Sinsabaugh discloses a reusable insert for supporting coreless rolls comprised of a rigid hollow tubular body. Despite having an inwardly tapered end section the Sinsabaugh insert is still difficult to pass through a coreless paper roll without tearing the innermost sheets of the roll, due to the pointed end corner or edge of the tapered section. As a result, the center hole of the roll must be manually opened more carefully and to a greater degree to use Sinsabaugh's insert, which is time consuming, difficult and generally frustrating since it will usually take at least several attempts to properly mount the insert without damaging the roll.

Thus, there remains a need for an reusable core replacement device for use particularly but not only with consumer packages of coreless paper rolls such as bathroom tissue paper, paper towels, and other rolled materials, that can be quickly and easily passed into and through the central aperture space of a coreless paper roll without requiring substantial preliminary manipulation of the roll and without damaging the innermost layers of the rolled material.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

SUMMARY OF THE INVENTION

The present invention provides a reusable coreless paper roll core replacement tool and method by which rolls of a web material such as but not limited to bathroom tissue and paper towels having an axial center opening may be mounted on a core replacement apparatus preparatory to passing a spindle or other support means through the center opening for dispensing or unrolling purposes. In one embodiment, the invention comprises a plastic or polymeric open-ended tubular construction having an outer surface for receipt of paper rolls for support and dispensing or unfolding plus at least one end section which may be detachable and having an inwardly inclined and in some embodiments a spheroidal or partially polygonal configuration designed for convenient and efficient insertion into a crushed or otherwise deformed center opening of a paper roll with a minimum of difficulty and minimum or no damage or degradation of the material contained in the roll. In another embodiment the core replacement tool includes an attachment device having a generally conically shaped section for use in combination with a reusable replacement core apparatus, which attachment device is detachably securable to one end of the reusable core apparatus and facilitates mounting of a paper roll on the reusable core and more particularly insertion of the core apparatus into the center opening of a coreless paper roll, after which the attachment is removed from the reusable core apparatus upon the core apparatus being completely inserted in the center opening of the roll. In some embodiments the attachment device includes a support section that fits snugly into an end of the core apparatus, and in other embodiments the attachment device is provided with an enlarged lip which is adapted to fit over the outer periphery of the core apparatus end surface.

In another embodiment, the core replacement tool includes an insertion aid having a generally polygonal-shaped insertion end and side surfaces which more closely match the irregular shape of the mashed, noncircular center opening of the rolls, which polygonal shape makes initial insertion of the aid into the roll center opening easier. The attachment end of the insertion aid in such embodiment has a cross sectional profile that matches the profile of the outer surface of the replacement core, which profile may be a circular or noncircular shape. In other embodiments an enlarged lip is positioned on one or both ends of the core apparatus to prevent the rolls from sliding off of the replacement core once mounted. Where the insertion aid is used with a core having a round or annular outer surface, the outer surface of the insertion aid includes a crenulated area which provides a smooth transition from a polygonal to annular shape. The invention also comprises a method of mounting coreless rolls of a web or sheet material on a reusable core apparatus using the core replacement tool of the invention in which a coreless roll is positioned so that the insertion end of the attachment or insertion aid, which is impermanently secured over an end of the replacement core apparatus, is initially inserted into the central opening or aperture of the roll in order to facilitate mounting of the roll on the reusable core. In addition, the invention includes a method of securing coreless rolls of sheet material on a reusable core apparatus in which after the insertion aid is impermanently secured over an end of the replacement core apparatus, which end may include an enlarged lip on its end, a coreless paper roll is positioned so the insertion end of the attachment device is initially inserted into the central aperture of the roll followed by the reusable core apparatus until the insertion aid has been passed completely through the central aperture, after which the insertion aid is removed and the roll is mounted on the core apparatus, and a spindle can be passed through the central opening or aperture of the core apparatus which spindle is then secured to a spindle support structure.

BRIEF DESCRIPTION OF THE DRAWINGS

The present invention will become more fully understood from the detailed description and the accompanying drawings, wherein.

DETAILED DESCRIPTION OF THE INVENTION

The following detailed description is of the best mode or modes of the invention presently contemplated. Such description is merely exemplary in nature and is not intended to be understood in a limiting sense, but to be an example of the invention presented solely for illustration thereof, and by reference to which in connection with the following description and the accompanying drawings one skilled in the art may be advised of the advantages and construction of the invention. Throughout the different embodiments illustrated herein, where possible like reference numbers have been utilized to refer to like elements or features of the invention.

Figure 1:
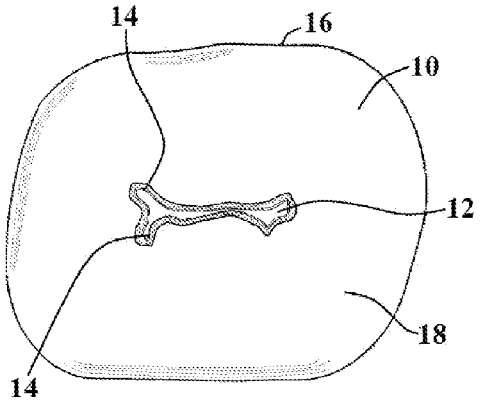
FIG. 1 is an elevation end view illustrating a coreless or tubeless roll of web material such as bathroom tissue as it may appear upon initial removal from a consumer package.

More and more, rolls of a web material such as paper, particularly those intended for household or consumer use such as but not limited to rolls of bathroom tissue and paper towels, are being manufactured without an inner support structure such as a tubular cardboard core. By way of example, FIG. 1 is an elevation end view of a coreless or tubeless roll of tissue paper 10 formed of a continuous sheet or web of such paper material usually containing a series of spaced-apart perforations that essentially divide the roll into a plurality of individual tear-off sheets in a manner well known to those skilled in the prior art. In FIG. 1, roll 10 appears as it might upon initial removal from a wrapper or package. It will be understood that rolls 10 may be sold in individually wrapped packages, but are more conveniently sold in bulk quantity packages such as those containing four, six, eight, twelve, twenty or various multiples thereof. The particular illustrated coreless roll 10 is designed to be used in the same manner as a core-wound roll in that each roll 10 has an axial center opening or aperture 12 which is initially oval or round but in any case has a diameter large enough for a spindle or other holding implement to be easily passed through in a conventional manner also known to those familiar with such rolls to facilitate mounting of the roll to a holder or dispensing device.

Due to the soft pliable nature of the paper, plus the fact that the paper is in general usually rather loosely wound to make it feel softer and fluffier to the consumer, as well as to make it easier to unroll during use, a substantial amount of air may be initially present in each roll and in each package, which if eliminated would comprise a significant space savings. In order to save space and reduce shipping costs, the rolls are therefore compressed tightly together to remove as much of the air and space between the sheets as possible, with multiple packages usually enclosing the rolls in a plastic wrapper. Both the individual rolls and multiple packages are even further compressed when placed on pallets and/or squeezed into a shipping container, truck, or other carrier. Later handling of the packages and storage at home may frequently compress the packages and contained rolls even further. The lack of a cardboard core, in addition to eliminating the expense of the cores, has the advantage that the rolls can be compressed to a greater extent than rolls wound on a cardboard core, such that the center hole 12 of the rolls is also compressed and the associated space is eliminated. Further, since paper rolls are considered non-fragile, tightly compressing the packages is generally not viewed as damaging the rolls, at least by the handler.

Each roll 10 such as in FIG. 1, while it may have been more or less circular in shape at the time of initial forming, as indicated above is very likely to have been compressed or mashed into a noncircular shape as shown. The center hole 12 in FIG. 1 in particular is distorted into a nonuniform shape and contains numerous creases 14 which are formed in the periphery of center hole 12, while outer surface 16 also will frequently have achieved a flattened, noncircular shape. In the illustrated condition, it becomes difficult to pass a support implement such as a spindle through center hole 12 without causing significant damage to the innermost convolutions of the delicate tissue material.

Figure 2:
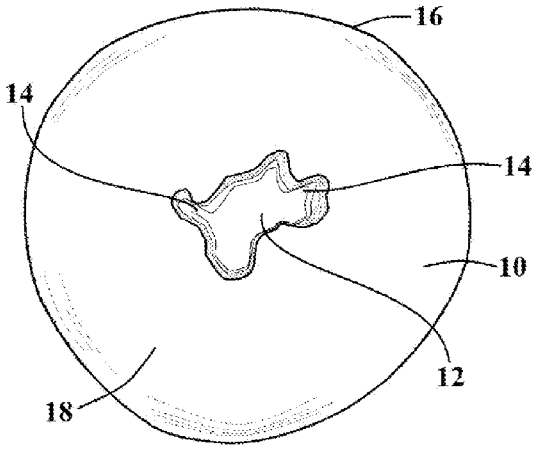
FIG. 2 is an elevation end view of the coreless or tubeless paper roll of FIG. 1 as it may appear after being manually manipulated to expand the center opening in the roll.

FIG. 2 illustrates roll 10 after it has been manually manipulated in an attempt to return the deformed roll to a substantially circular shape. Where the tissue material is of a soft and pliable nature, it is relatively easy to reshape the outer surface 16 and a significant portion of body 18 of the roll 10 so that it again has a more or less circular shape or appearance. More difficulty is encountered, however, in attempting to reshape center hole 12 back to a substantially circular or uniform oval shape. In particular, creases 14 formed in the perimeter of center hole 12 cannot be completely removed primarily because the paper has been stretched or otherwise permanently physically altered by the forces of compression or other packaging and shipping forces or stresses exerted on the roll. Thus, as in FIG. 2 center hole 12 can be opened somewhat, but at best the center hole 12 will continue to have an at least partially ragged or bumpy inner wall surface.

Figure 3:
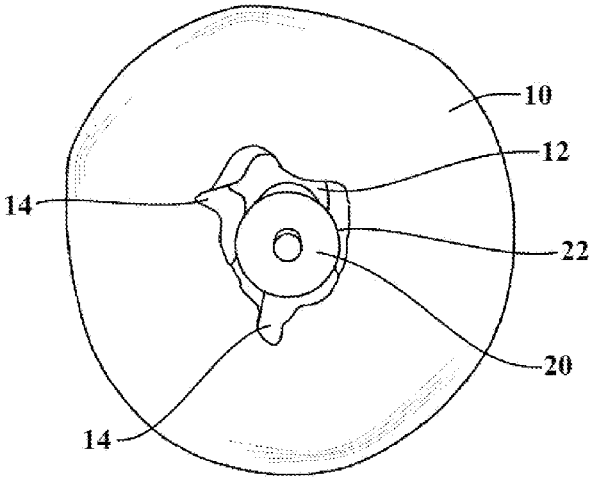
FIG. 3 is an elevation end view of the coreless or tubeless paper roll of FIGS. 1 and 2 mounted on a conventional spindle.

In FIG. 3, a standard round tissue paper holder spindle 20 is shown inserted in center hole 12 of coreless roll 10. It will be readily evident that once the spindle 20 is replaced on a paper holder with the ends of the spindle 20 extending between a pair of holding plates or brackets in a conventional manner, when the outermost end sheet or sheets of the roll 10 are grasped and pulled outwardly to remove a plurality of sheets from the roll, the roll 10 will not rotate smoothly on spindle 20, but rather spindle 20 will tend to get caught in the creases or channels 14 in the surface of central hole 12. In cases where the paper is of a delicate nature such as bathroom tissue sheets, the added resistance to turning caused by the deformed center hole 12 can cause the paper to tear unintentionally, particularly at one of the perforations, since the force required to turn the roll 10 on spindle 20 and to remove spindle 20 from one of the creases 14 will likely be at least in some cases greater than the tearing strength of the perforations, which are designed to tear as a result of a minimum amount of manual exertion or force.

Where the coreless paper roll 10 is pressing tightly against spindle 20, the spindle 20 will tend to rotate with the roll 10 as the paper is dispensed, which is possible with some spindles but not all roll supports. Usually, however, when mounting a roll 10 on spindle 20 the center hole 12 would have to be made substantially wider than the diameter of spindle 20 to prevent tearing of the inner layers of paper. A further consideration is that many conventional spindles 20 have a sharp corner or edge along their outer ends 22 which while perfectly suited for use with paper rolls wound on a circular cardboard core having a more rugged construction, upon attempting to insert the spindle 20 into center hole 12 of a paper roll 10 not having a tubular core, the sharp corner or edge can easily catch against and tear the innermost layers or sheets of roll 10 closest to center hole 12, destroying a significant number of sheets and rendering them essentially unusable. It has also been found that spring-loaded spindles having a smaller diameter section which extends telescopically from a larger diameter section can cause similar tearing even if the smaller section is inserted in center hole 12 first, since the inner edge of the larger diameter section adjacent the smaller section is also usually not rounded or curved and will also catch against and tear the paper.

Figure 4:
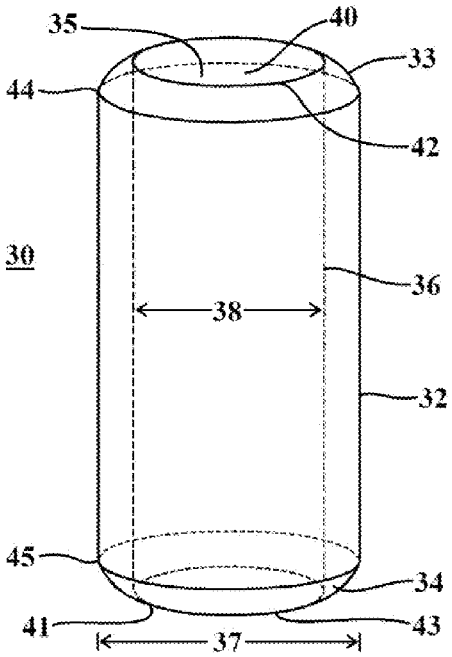
FIG. 4 is a side view of an embodiment of a coreless paper roll support apparatus in accordance with the present invention.
Figure 5:
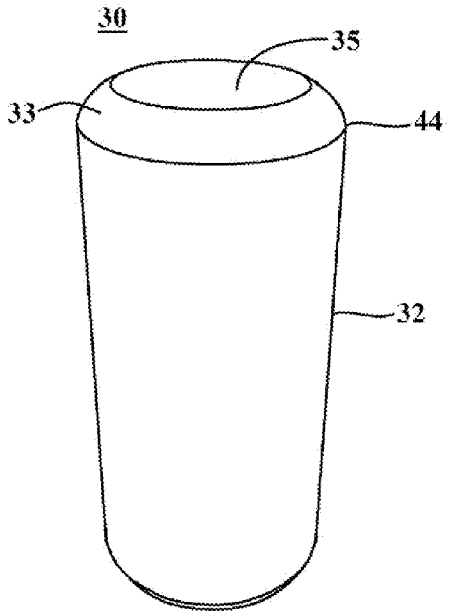
FIG. 5 is a perspective view of the coreless paper roll support apparatus shown in FIG. 4.

Referring now to FIGS. 4 and 5, there is illustrated an exemplary embodiment of a coreless paper roll support apparatus 30 in accordance with the present invention. Apparatus 30 is comprised of an elongated single piece tubular member or cylindrical construction preferably made of PVC plastic and formed by an extrusion or injection molding process, although other materials such as aluminum, wood, metal, as well as other polymeric materials and other forming methods may also be utilized. Apparatus 30 as shown has a center section 32, first and second angled end sections 33 and 34, and a through-aperture 35 extending longitudinally between end sections 33 and 34 and defined by an interior wall 36. The outer diameter 37 of center section 32 is sized to be received in the center hole 12 of a coreless paper roll 10. In addition, the inner diameter 38 of through-aperture 35 is sized to receive a paper holder spindle 20 or other paper roll holding member. Through-aperture 35 also has first and second open ends 40 and 41 defined by edges 42 and 43, which also form the edges of first and second end sections 33 and 34, respectively, while end sections 33 and 34 meet center section 32 at the points indicated by reference numerals 44 and 45, respectively. In a preferred embodiment apparatus 30 is adapted to be used with a roll of bathroom tissue or toilet paper of standard size, in which apparatus 30 has a length from edge 42 to edge 43 of about 4 inches, an outer diameter 37 of between about 1¼ inches and about 2¼ inches, and an internal diameter 38 of about 1 to 2 inches. In another preferred embodiment, apparatus 30 may be manufactured using standard size PVC pipe having an outside diameter of between about 1¼ inches and about 2¼ inches, and an internal diameter of about 1 to 2 inches, therefore saving the cost of manufacturing specially sized tubular members. It will be understood however that the actual dimensions of apparatus 30 and the other exemplary embodiments herein can be varied according to the dimensions of the roll 10, center hole 12 and spindle 20 or other roll holding member while still falling within the intended scope of the present invention.

To minimize tearing of the paper, the outer surfaces of center section 32 and end sections 33 and 34 of roll support apparatus 30 are generally smooth and together form a continuous smooth exterior surface. Interior wall 36 of through-aperture 35 is also preferably circular and generally smooth. End sections 33 and 34 of apparatus 30 are angled inwardly extending from center section 32 to edges 42 and 43, respectively. In some embodiments, the outer surface of end sections 33 and 34 may have a rounded configuration extending from center section 32 to edges 42 and 43, forming a dome or spheroidal shape. As long as the outer surface of center section 32 and end sections 33 and 34 provides a continuous smooth surface, with end sections 33 and 34 terminating at edges 42 and 43, apparatus 30 may be easily inserted in the center opening of a web material roll as set forth below. The rounded or dome-shape of end sections 33 and 34 provided in some embodiments has been found to further increase the ease with which apparatus 30 may be inserted in the center hole 12 of a paper roll 10 without binding with and tearing the innermost layers of sheet material nearest center hole 12, as contrasted to simply being inwardly tapered. It is believed that the hemispherical or spheroidal shape would be the least likely to catch in the layers of tissue and a regular curve in the form of a portion of a circle or hemisphere would be the most adaptable to various angles of approach to the end of the tissue roll and the most tolerant of slight variations to such angles of approach. In one arrangement, the thickness of the walls of apparatus 30 at end surface sections 33 or 34 is gradually reduced from center section 32 to edges 42 and 43 and in some embodiments the end surface sections from points 44 and 45 to edges 42 and 43, respectively, are rounded, rather than just being inclined inwardly. In some embodiments, the outer edges 42 and 43 of end surface sections 33 and 34 which join with the terminal ends of sidewall 36 of through-aperture 35 are also smoothed or rounded so as to completely eliminate any sharp edges on apparatus 30. In some embodiments, one or both of end sections 33 and 34 may be detachable from center section 32, while in some other embodiments apparatus 30 may have only one inwardly inclined end section.

Figure 6:
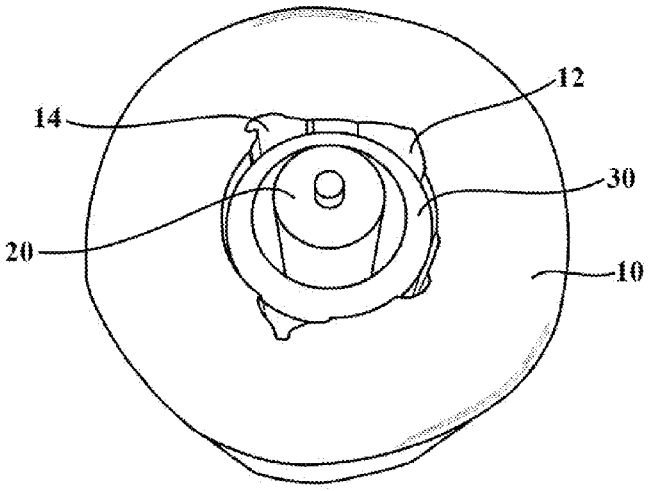
FIG. 6 is an end view of a coreless or tubeless paper roll mounted on the roll support apparatus shown in FIGS. 4 and 5 including a conventional spindle.

In FIG. 6, apparatus 30 is shown having been inserted into the center hole 12 of a paper roll 10. In a usual case, apparatus 30 will be held manually in one hand and roll 10 will be held in the other hand, and one of the end surface sections 33 or 34 of apparatus 30 will be aligned with center hole 12 and pressed inwardly into the hole. A twisting motion in combination with inward force and an initial angled entry may be used to aid in inserting either end section 33 or 34 into hole 12. More particularly, if center hole 12 is more significantly deformed in transport or is not very large, apparatus 30 may initially be held at an angle typically of 30 degrees or less with respect to center hole 12 so that a portion of end surface sections 33 or 34 is pressed into contact with the inner surface of hole 12, causing the innermost layers of the paper material being contacted to be expanded outwardly somewhat. Such angles of initial entry of end sections 33 and 34 are possible due to the particular construction of the end sections 33 and 34, and in particular in large part because the end sections taper inwardly all the way to edges 42 and 43, or substantially the full width of the plastic or other material used in forming apparatus 30. This places edges 42 and 43 both at an angle and at a position where if the apparatus 30 is held at even a slight angle with respect to center hole 12, the outer surface of end section 33 or 34 will contact the paper material around center hole 12 before edges 42 and 43 and tend to spread the center hole 12 outwardly. Further, the angle of edges 42 and 43 is not directed forwardly but inwardly, which also reduces tearing if brought into direct contact with the paper material. Thus, apparatus 30 not only is operative as a support apparatus but also as a tool for widening the center hole 12 at least equally if not more efficiently and effectively than manual straightening, and preferably eliminates the need for manual straightening altogether. Once the end section is partially inserted, apparatus 30 may then be straightened out or aligned with axial central hole 12 and pressed inwardly as described above, wiggling and/or twisting the apparatus 30 back and forth somewhat as necessary until apparatus 30 is completely inserted in hole 12, without edges 42 and 43 causing tearing or damage to the paper material. In the embodiment where the end sections are hemispherically shaped, this effect is further enhanced. Spindle 20 may then be inserted in through-aperture 35 of apparatus 30 in the same manner as it would be inserted in a conventional cardboard core.

It is evident in FIG. 6 that while the center hole 12 still has a ragged or uneven surface, including numerous creases or folds 14, the inner surface 36 of aperture 35 in apparatus 30 provides a significantly more uniform, rounded, and rigid surface which contacts the outer surface of spindle 20. Thus, when spindle 20 is inserted into aperture 35, despite the nonuniform surface of center hole 12, when roll 10 is secured to a dispensing device and is turned to dispense one or more sheets from such roll, the roll 10 will rotate smoothly and easily with the inner surface 36 of aperture 35 of apparatus 30 in contact with the similarly smooth and rounded outer surface of spindle 20. In fact, it has been found that coreless roll 10 turns more easily than if a cardboard core or the like had been provided.

Figure 7:
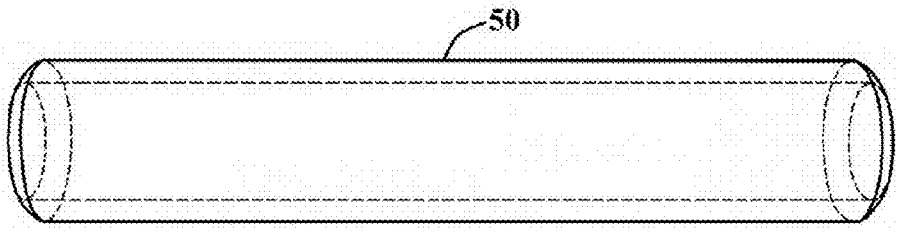
FIG. 7 is a side view of the coreless paper roll support apparatus adapted for use with rolls of paper towels.

FIG. 7 illustrates an alternative embodiment of the present invention which is designed to support a wider paper roll such as a roll of paper towels rather than a bathroom tissue sized roll. Essentially the main difference between apparatus 50 shown in FIG. 7 and apparatus 30 shown in FIGS. 4-6 is in the dimensions of apparatus 50. More particularly, a typical roll of household bathroom tissue or paper has a width of about between four and five inches, so that apparatus 30 in FIGS. 4-6 correspondingly also preferably has a length of about between four and five inches, while a typical roll of paper towels has a width of between about eleven and about twelve inches and therefore the apparatus 50 may typically have a length of between about 10½ to about 12 inches.

Figure 8:
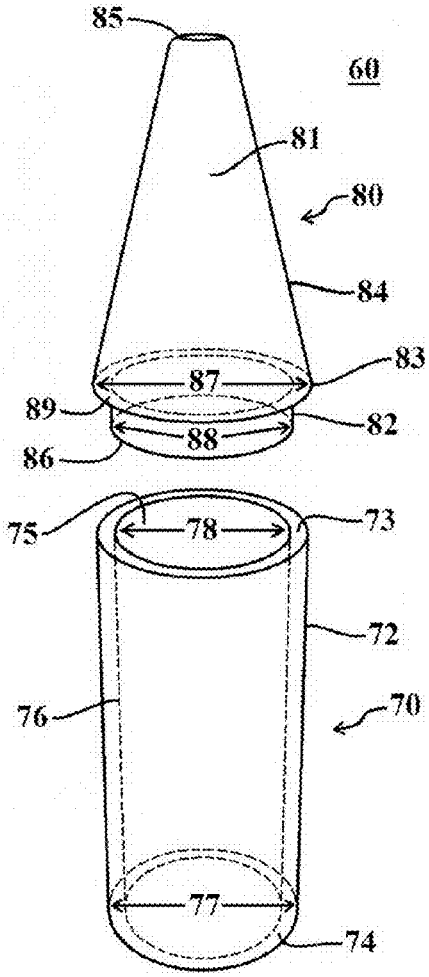
FIG. 8 illustrates another embodiment of the present invention including a coreless paper roll support apparatus and a detachable insertion aid or attachment member.

FIG. 8 illustrates another embodiment of the present invention in which the core replacement tool 60 includes generally a support apparatus 70 and attachment member or insertion aid 80. Support apparatus 70 includes a tubular member or cylindrical construction that may be made of PVC plastic, although other materials and methods of manufacture as described above with respect to apparatus 30 may be used. Support apparatus 70 has an outer surface 72, a first end surface 73, a second end surface 74, a through-aperture 75 extending longitudinally between end surfaces 73 and 74, an inner surface 76, an outer diameter 77 and an inner diameter 78. The main difference between support apparatus 70 in the presently described embodiment and previously described support apparatus 30 is that surfaces 73 and 74 of apparatus 70 are substantially perpendicular to outer and inner surfaces 72 and 76 while end sections 33 and 34 of apparatus 30 angle inwardly and terminate at points 42 and 43, thus eliminating such end sections. As set forth in greater detail below, apparatus 70 does not require its end surfaces to be rounded because in use attachment member 80 is positioned directly over either end surface 73 or 74 prior to insertion of apparatus 70 into a coreless paper roll center hole.

In its preferred embodiments, the dimensions of apparatus 70 of tool 60 vary slightly from the embodiments described for apparatus 30. Apparatus 70 preferably has a longitudinal length from surface 73 to surface 74 which is within a range of being slightly greater and slightly less than the width of the rolled paper material to be mounted on apparatus 30. Outer diameter 77 is dimensioned to fit in a coreless paper roll center hole or aperture, and inner diameter 78 is dimensioned to receive a paper holder spindle 20 or other roll holding member. In a preferred embodiment, apparatus 70 has a length of about 4 inches, outer diameter 77 is between about 1¼ inches and about 2¼ inches, and the internal diameter 78 of through-aperture 75 is about 1 to 2 inches. In another preferred embodiment, apparatus 70 may be manufactured from standard size PVC pipe having an outside diameter of between about 1¼ inches or about 2¼ inches, and an internal diameter of about 1 to 2 inches.

Attachment member 80 of core replacement tool 60 includes a generally conically-shaped element 81 and a cylindrical element 82 connected extending outwardly from the base 83 of the cone-shaped element 81. The attachment member 80 may be manufactured from a single piece of solid material such as PVC plastic that has been machined or extruded into its operative shape, or from two separate pieces, a cone-shaped element and a cylindrical element that have been permanently secured together by a suitable means such as by an adhesive to form a single attachment member or device. Other arrangements for manufacturing or providing conical attachment 80 while still falling within the intended scope of the present invention are also contemplated.

The tapered outer surface 84 of cone-shaped element 81 is substantially smooth and has a tip or insertion end 85 that in some embodiments is substantially rounded or spherical and forms the vertex or apex of the attachment member 80. The cylindrical element 82 protrudes from the base 83 of the cone-shaped element 81 and has a bottom surface 86, which also forms the end of the attachment member 80 opposite insertion end 85. The diameter 87 of cone-shaped element 81 at base 83 is larger than the diameter 88 of cylindrical element 82, defining a lip 89 on base 83. In addition, the diameter 88 of the cylindrical element 82 is less than the inner diameter 78 of support apparatus 70, and preferably just slightly less than inner diameter 78 so as to provide a close or possible friction fit when as set forth below the cylindrical element 82 is inserted impermanently into the through-aperture 75 of the support apparatus 70. In addition, the diameter 87 of the cone-shaped element 81 adjacent cylindrical element 82 is approximately the same as or slightly greater than the outer diameter 77 of the support apparatus 70.

In one embodiment, the length of the cone-shaped element 81 of attachment member 80 is about 3⅛ inches and the length of the cylindrical element 82 is about ⅜ inches, giving the attachment member 80 a total length of 3½ inches when measured from the rounded tip 85 to bottom surface 86. The diameter 87 of the base 83 of cone-shaped element 81 is between about 1¼ inches or about 2¼ inches, and the diameter 88 of the cylindrical element 82 is between about 1³⁄₁₆ to 2³⁄₁₆ inches. In a preferred embodiment, the rounded or dome-shaped tip 85 forms an angle of about 15 degrees when measured from the outer surface 84 to the longitudinal center axis of the cone-shape element 81 extending from tip 85 to the base 83. It is noted that cylindrical element 82 may also be angled inwardly extending from its connection with cone-shaped element 81 at base 83 to bottom surface 86 in order to save on material or to make it easier to connect attachment member 80 to support apparatus 70 as set forth below.

To use core replacement tool 60, the attachment member 80 is temporarily attached to the support apparatus 70 by inserting the cylindrical element 82 of the attachment member 80 into the through-aperture 75 of the support apparatus 70 until lip 89 is in abutment with outer surface 73 or 74. Once cylindrical element 82 is inserted into the through-aperture 75, the core replacement tool 60 has the appearance of being a unitary device having a cylindrical body and a rounded or dome-shape pointed end. The narrowed insertion end or rounded tip 85 of the attachment member 80 can then be juxtaposed with and inserted into one end of the axial center hole 12 of a coreless paper roll 10, in some cases at a slight angle initially, so that the center hole 12 is gradually expanded. Once attachment member 80 is inserted at least partially into center hole 12, support apparatus 70 is then pushed substantially completely into center hole 12 of paper roll 10, or until the attachment member 80 surfaces through the opposite side of the center hole 12 of the paper roll 10. The temporary attachment member 80 can then be removed from the core replacement or support apparatus 70, thereby leaving the core replacement or support apparatus 70 within the center hole of the coreless paper roll 10.

The conical element 81 of the attachment member 80 provides a significantly smaller diameter tip 85 than is possible with the previously described embodiment of support apparatus 30, which aids in initial insertion of the attachment member 80 into the deformed or asymmetrical center hole 12 of a tubeless paper roll 10. Attachment member 80 also helps guide and gradually open the center hole 12 as the support apparatus 70 is pushed into and through the center hole 12 of the tubeless paper roll 10, thereby minimizing any mashing or tearing of sheet material near the center hole 12 and reducing the time spent trying to manually open center hole 12 wide enough to accommodate a support apparatus or reusable core 70.

Figure 9:
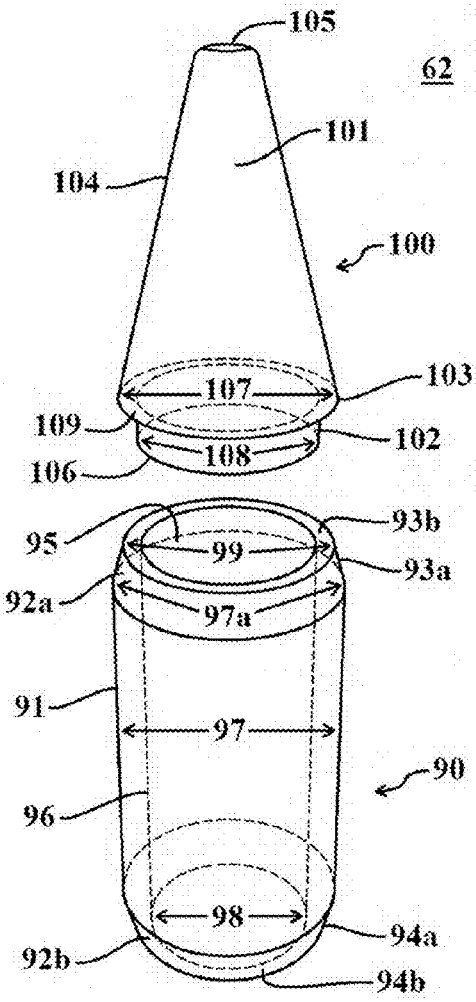
FIG. 9 illustrates another embodiment of the present invention including a coreless paper roll support apparatus having inwardly angled end sections and a detachable insertion aid or attachment member.
Figure 10A:
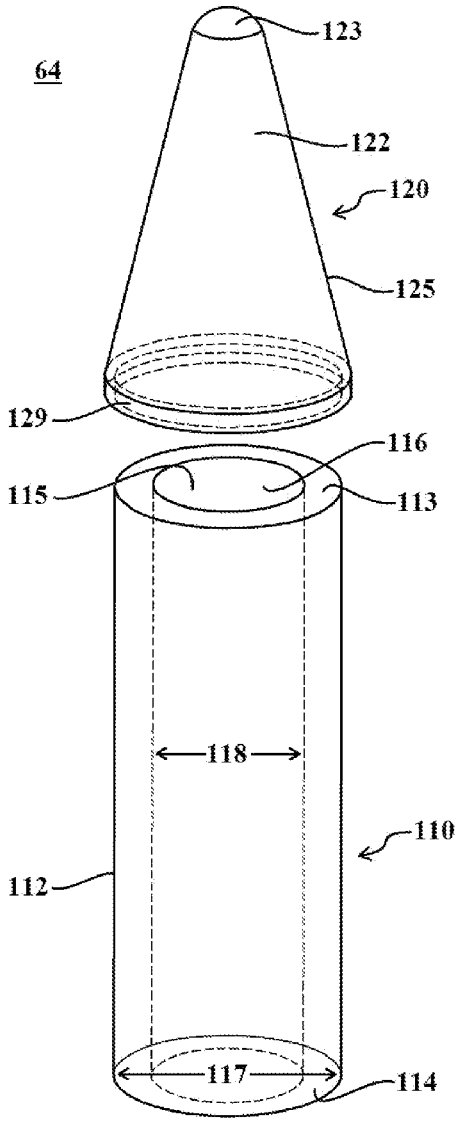
FIGS. 10*a* and 10*b* illustrate side elevation and sectional views of another embodiment of the present invention including a coreless paper roll support apparatus and detachable insertion aid or attachment member.
Figure 10B:
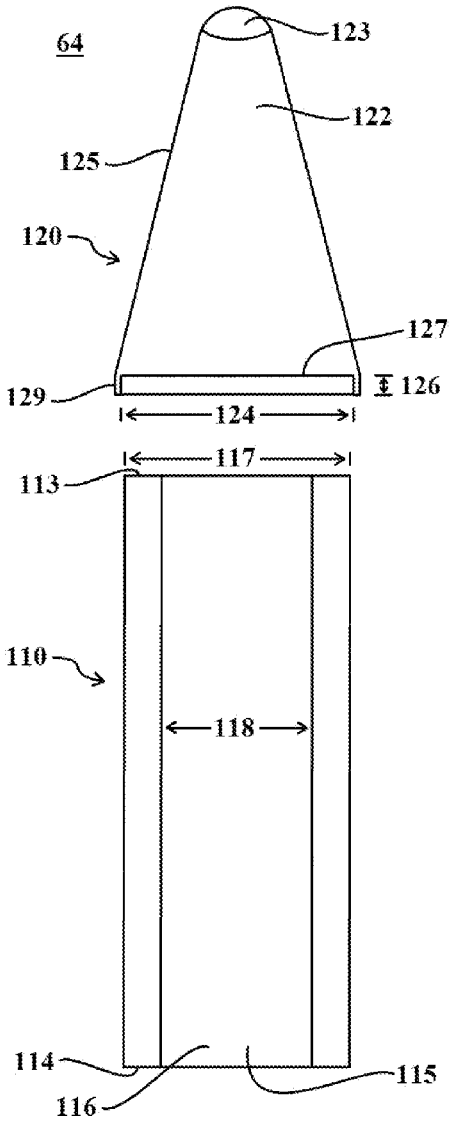

FIG. 9 illustrates another embodiment of the core replacement tool of the present invention in which core replacement tool 62 includes a support apparatus 90 and attachment member 100. As compared to the embodiment shown in FIG. 8, support apparatus 90 of tool 62 shown in FIG. 9 has a center section 91, and adjacent to center section 91 on either side is pair of end sections 92*a* and 92*b* each having angled outer surfaces 93*a* and 94*a* that terminate at end surfaces 93*b* and 94*b*. A through-aperture 95 having an inner surface 96 extends longitudinally through apparatus 90 between end surfaces 93*b* and 94*b*. The outer surface of center section 91 has an outer diameter 97, and end sections 92*a* and 92*b* have a diameter 97*a* at the base or connection point with center section 91 which is the same as outer diameter 97. Through-aperture 95 has an inner diameter 98, and end sections 92*a* and 92*b* have an outer diameter 99 at each of the flat end surfaces 93*b* and 94*b*. End surfaces 93*b* and 94*b* are preferably oriented perpendicular to the outer surface of center section 91 and to side walls 96 of through-aperture 95, while end sections 92*a* and 92*b* taper or angle inwardly from outer diameter 97*a* to diameter 99.

The angled outer surfaces 93*a*, 94*a* and flat end surfaces 93*b*, 94*b* of end sections 92*a*, 92*b* together give sections 92*a*, 92*b* the shape of a transected cone in which the base diameter 97*a* is the same size as the outer diameter 97 of the cylindrical center section 91 of the support apparatus 90. As in the previous embodiments, the outer surfaces of support apparatus 90 are smooth, and the outer diameter 97 is sized to be inserted in center hole 12 of a paper roll 10. Inner diameter 98 of through-aperture 95 is sized to receive a paper holder spindle 20 or other paper roll holding member. In a preferred embodiment, the length of support apparatus 90 from ends 93*b* to 94*b*, is about 4 inches. In a preferred embodiment, support apparatus 90 may be constructed of the same materials disclosed in previous embodiments.

Attachment member 100 of core replacement tool 62 is similar to the attachment member 80 of FIG. 8, except having slightly different dimensions adapted to correspond with the dimensions of support apparatus 90. Attachment member 100 is comprised of a cone or generally conically-shaped element 101 and a cylindrical element 102 connected extending outwardly from the base 103 of the cone-shaped element 101. The tapered outer surface 104 of cone-shaped element 101 is substantially smooth and has a substantially smooth, rounded or spherical tip or insertion end 105 that forms the top or apex of the attachment member 100. The cylindrical element 102 protrudes from the base 103 of the cone-shaped element 101 and has a bottom surface 106, which also forms the bottom end of the attachment member 100. The diameter 107 of the base 103 of the cone-shaped element 101 is larger than the diameter 108 of cylindrical element 102, defining a lip 109 that extends outwardly past the outer walls of the cylindrical element 102.

Similar to attachment member 80, the diameter 108 of the cylindrical element 102 of attachment member 100 is slightly less than the inner diameter 98 of through-aperture 95 of the support apparatus 90, so that there is a close fit between the attachment member 100 and support apparatus 90 when the cylindrical element 102 of the attachment member 100 as set forth below is inserted into the through aperture 95 of the support apparatus 90. The diameter 107 of the base 103 of the conical element 101, however, is sized to be approximately the same or slightly greater than the outer diameter 99 of flat ends 93*b* and 94*b*.

The outer surface of conical element 101 of the attachment member 100, and the outer surfaces 93*a* and 94*a* of end sections 92*a* and 92*b* are preferably angled at approximately the same angle, such that when the attachment member 100 and support apparatus 90 are connected as set forth below, the outer surface 93*a* or 94*a* of end sections 92*a* or 92*b* and the outer surface 104 of the conical element 101 are substantially aligned in a straight line or at the same angle. In a preferred embodiment, the dome-shaped tip or apex 105 of the conical element 101 of core replacement tool 62 forms an angle of about 15 degrees when measured from the outer surface 104 to the longitudinal axis of the conical element 101 extending from rounded tip 105 to the base 103.

In use, core replacement tool 62 as shown in FIG. 9 is operated in substantially the same manner as described with respect to the embodiment shown in FIG. 8. The attachment member 100 and support apparatus 90 are operatively joined by inserting the cylindrical element 102 of the attachment member 100 into the through-aperture 95 of the support apparatus 90. The dome-shaped or rounded insertion end 105 of the attachment member 100 is then inserted into the center hole 12 of a paper roll 10. Once inserted, the opposing end of the support apparatus 90 is grasped and pushed into the paper roll 10 until the support apparatus 90 is substantially completely contained in center hole 12, and attachment member 100 surfaces through the other side of the center hole 12 of the paper roll 10. The attachment member 100 can then be removed from the support apparatus 90, thereby leaving the support apparatus 90 within the coreless paper roll 10.

FIGS. 10*a-b* and 11*a-b* illustrate another exemplary embodiment of the tool of the present invention, in which core replacement tool 64 includes a core replacement or support apparatus 110 and an attachment member 120. Core replacement or support apparatus 110 is similar to the apparatus 70 shown in FIG. 8 as it is also comprised of a tubular member that may be made of PVC plastic, although other materials may be used such as those disclosed above with respect to the previously described embodiments. Support apparatus 110 has an outer surface 112, first and second end surfaces 113 and 114, a through-aperture 115 extending longitudinally between ends 113 and 114, an inner surface 116, an outer diameter 117 and an inner diameter 118. Outer diameter 117 of apparatus 110 is dimensioned to be received in the center hole of a coreless paper roll, and inner diameter 118 of through-aperture 115 is large enough to receive a paper holder spindle 20 or other type of paper roll holding member.

In its preferred embodiments, the dimensions of apparatus 110 are the same as described with respect to apparatus 70. In one embodiment, apparatus 110 has a length of about 4 inches, an outer diameter 117 of between about 1¼ inches and about 2¼ inches, and an internal diameter 118 of about 1 to 2 inches. In another embodiment, the apparatus 110 may be manufactured from standard size PVC pipe having an outside diameter of between about 1¼ inches or about 2¼ inches, and an internal diameter of about 1 to 2 inches.

The attachment member 120 of core replacement tool 64 is similar to attachment member 80 in that it includes a cone-shaped element 122; however, instead of having a cylindrical element connected to the lower end or base 127 of the cone-shaped element, attachment member 120 has a peripheral lip 129 that extends outwardly a distance 126 from the base 127 of cone-shaped element 122, or downwardly as oriented in the Figures. Attachment member 120 is preferably manufactured from a single piece of solid material that has been machined, injection molded, or extruded into its operative shape, although attachment 120 could also be made from separate pieces that have been secured together such as by an adhesive to form a single attachment apparatus. Other arrangements and processes for manufacturing or providing conical attachment 120 while still falling within the intended scope of the present invention are also contemplated.

The tapered outer surface 125 of cone-shaped element 122 of core replacement tool 64 is substantially smooth and has a substantially dome-shaped or rounded tip or insertion end 123 that forms the top or apex of the attachment member 120. Peripheral lip 129 as best shown in the sectional view of FIG. 10*b* extends downwardly from the lower end 127 of cone-shaped element 122. The diameter 124 of the circular space enclosed within the peripheral lip 129 is slightly larger than the outer diameter 117 of support apparatus 110 so as to provide a close or possible friction fit when as set forth below the attachment member 120, by way of its peripheral lip 129, is fitted over the support apparatus 110.

In a preferred embodiment, the total length of the attachment member 120 is between about 2 to 3½ inches. The length 126 of the downward extension of the peripheral lip 129 is about 3/16 inches and its thickness is preferably about 0.04 inches. The diameter 124 of the circular space enclosing the peripheral lip 129 is between about 1¼ to 2¼ inches. In a preferred embodiment, the rounded or dome-shaped tip 123 forms at an angle of about 15 degrees when measured from the outer surface 125 to the longitudinal axis of the cone-shaped element 122.

Figure 11A:
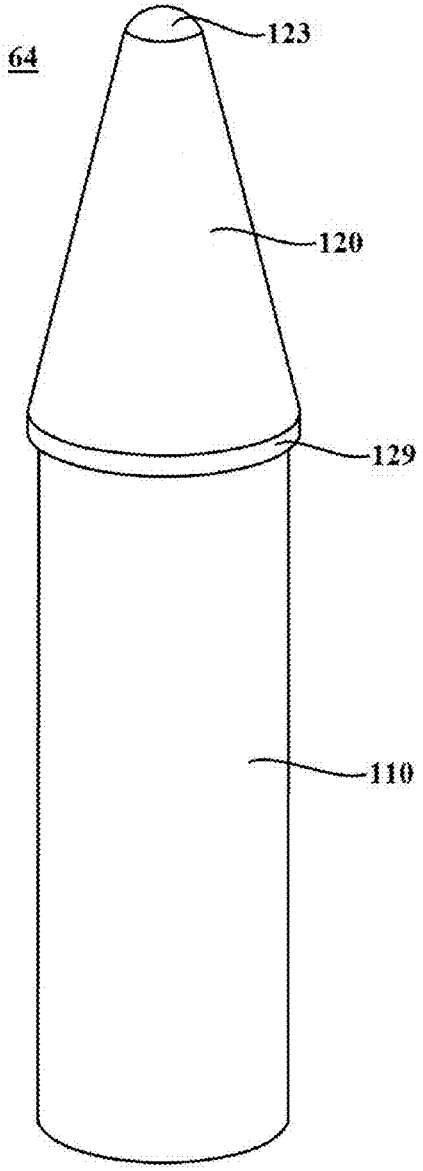
FIGS. 11*a* and 11*b* illustrate the support apparatus and detachable insertion aid or attachment member of FIGS. 10*a* and 10*b* in a use configuration.
Figure 11B:
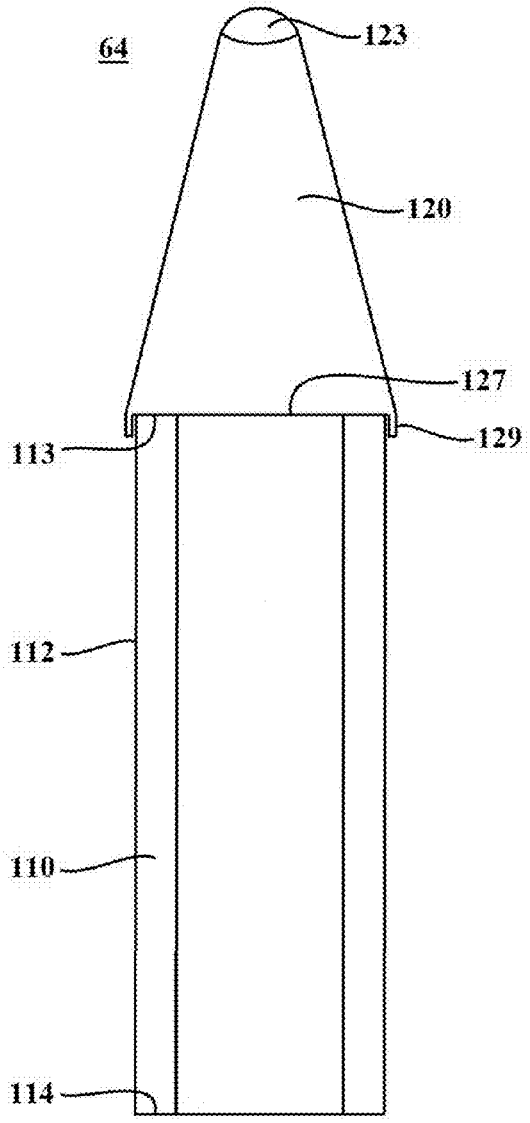

In use, as shown in FIGS. 11*a* and 11*b*, end 113 of support apparatus 110 is fitted into aperture 127 of attachment member 120 with peripheral lip 129 over a portion of the outer surface 112 of support apparatus 110. The attachment member 120 is easily temporarily attached to the support apparatus 110 by inserting one end 113 or 114 of the support apparatus 110 into the circular space enclosed by peripheral lip 129 on the lower end 127 of the attachment member 120, with lip 129 extending over the outer surface 112 of support apparatus 110, preferably providing a close or frictional fit between the inner surface of lip 129 and outer surface 112 of apparatus 110. The connection between support apparatus 110 and attachment member 120 of core replacement tool 64 is temporary or impermanent and should not be so strong that attachment member 120 is difficult to remove from apparatus 110 manually. Once lip 129 is placed over the outer surface 112 of support apparatus 110, the attachment member 120 and support apparatus 110 appear as a unitary device including a cylindrical body having a smooth outer surface and a dome-shape pointed end section. The rounded tip or insertion end 123 of the attachment member 120 can then be juxtaposed with and inserted into the center hole 12 of a paper roll 10. Once at least partially inserted, core replacement apparatus 110 is pushed substantially completely into center hole 12 of paper roll 10, or until the attachment member 120 is passed out through the opposite side of the center hole 12 of the paper roll 10. The attachment member 120 can then be removed from the support apparatus 110, preferably without the user having to hold support apparatus 110 out of center hole 12, thereby leaving the support apparatus 110 within the paper roll 10. Support apparatus 110 with roll 10 attached can then be mounted on a spindle 20 in a conventional manner. Once the paper roll is used up, attachment member 120 may then again be connected to support apparatus 110 and passed through the center hole of another paper roll 10 to mount the new roll on apparatus 110.

Figure 12:
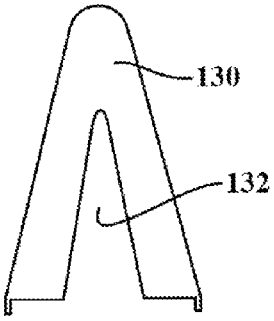
FIG. 12 is a cross-sectional view of an alternative conical attachment arrangement.

FIG. 12 illustrates an alternative embodiment of the attachment member 120. In FIG. 11*b* the attachment member 120 is shown having a solid body section which has been formed in the desired shape by injection molding or the like. Thus, no cost-saving material has been removed from the internal body of the attachment member 120. In FIG. 12, however, attachment member 130 has been modified so that a portion of the internal body of such attachment member 130 has been removed or omitted during manufacture, leaving a pocket 132 in the center area of attachment member 130. This provides a substantial cost savings in terms of materials used as well as shipping weight. It will be understood that additional material or pockets of material can be removed from solid attachment member 120 as long as attachment member 130 has sufficient rigidity and durability to be repeatedly used in the manner described herein and attachment member 130 has a smooth rounded outer surface as described above. It will also be understood that the various parts of the invention except where stated can in some embodiments have different shapes and dimensions while still falling within the intended scope of the present invention.

Figure 13A:
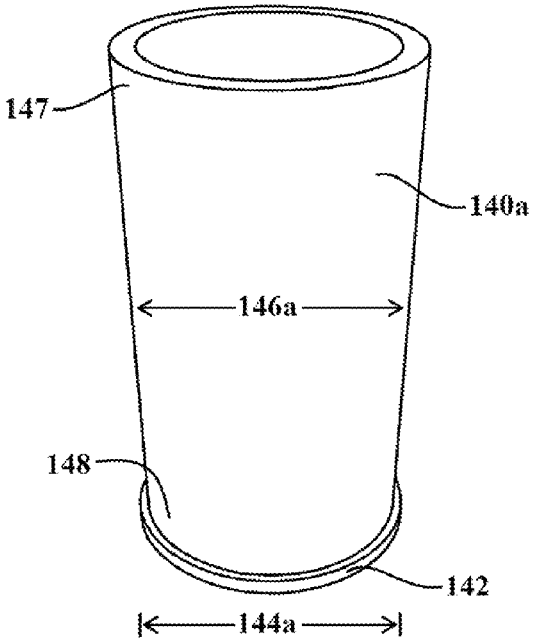
FIGS. 13*a* and 13*b* illustrate another embodiment of the coreless paper roll support apparatus having an enlarged lip on one end.
Figure 13B:
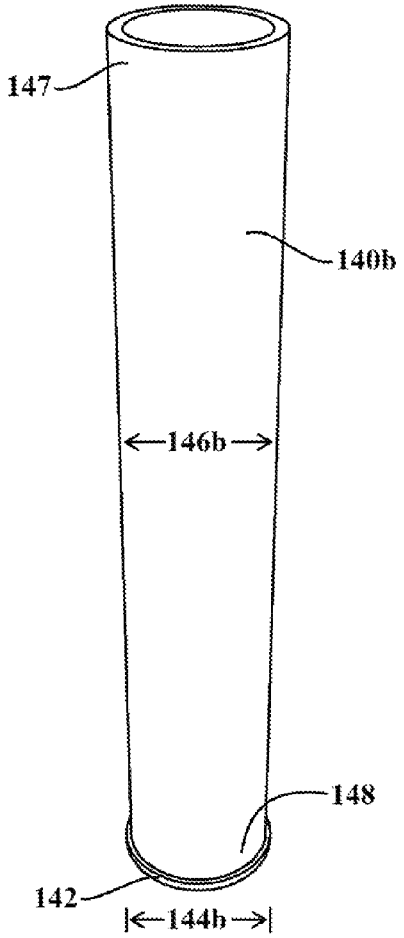

FIGS. 13*a* and 13*b* illustrate a further embodiment of the support apparatus 140*a* and 140*b* of the present invention adapted for use as a support for a bathroom tissue and paper towel roll, respectively. Apparatuses 140*a* and 140*b* are similar to apparatus 70 shown in FIG. 8 except having a ring member or enlarged lip section 142 on one end having a diameter 144*a*, 144*b* that is larger than the outer diameter

146*a*, 146*b* of apparatuses 140*a*, 140*b*, respectively. The enlarged ring member 142 in one embodiment has a width of about $\frac{1}{8}^{th}$ of an inch and a diameter 144*a*, 144*b* that is larger than the outer diameter of the base of the attachment member. In use with one of the attachment members 80, 100, 120, 130 discussed above, the attachment member will be inserted over end 147 of apparatus 140*a*, 140*b*, and the support apparatus inserted into the roll center hole as described above. Enlarged ring section 142 will prevent support apparatus 140*a*, 140*b* from passing completely through center hole 12 since ring 142 will engage with the outer surface of the roll 10. Provision of ring section 142 also prevents the roll from slipping off end 148 of support apparatus 140*a*, 140*b* as it might in certain circumstances where the holder or support for the paper roll is comprised of a single rigid member or the like.

In any of the exemplary embodiments, the tapered end of the attachment member of core replacement tool prior to the attachment member being connected to the replacement core apparatus can be used separately to manually assist in readying the central aperture of the coreless paper roll for receiving the replacement core apparatus. In particular, the tapered end of the attachment member may be inserted into one of the ends of the central aperture of the coreless paper roll at a position where the aperture is open wide enough to receive the apex of the tapered end. Then the apex end can be pressed against the side wall of the central aperture to gradually open the central aperture wider and also to move any of the innermost layers of the paper roll outwardly away from the central aperture, after which the tapered end may be pressed further into the central aperture. The user can perform this process on both ends of the central aperture if desired although this is generally not thought to be necessary in most cases because as the core replacement tool is inserted into the central aperture as described above, the center opening in the paper roll will be gradually widened or expanded automatically. This process in combination with perhaps some further relatively light manual manipulation significantly aids in readying the mashed, noncircular aperture for easy insertion of the generally circular replacement core apparatus without tearing of the innermost paper convolutions or encountering any other resistance to entry.

With any of the illustrated embodiments, another consideration is that the roll of paper or other flexible sheet material should not rotate too easily upon the replacement core or spindle, and it may be necessary or desirable in some instances to roughen the inner contacting surface of the support apparatus or the outer surface of the spindle to be passed through the support apparatus, depending upon the materials used. It is often frustrating for a bathroom tissue roll to unroll too easily and "spill" paper when one tries to tear off only a few perforated sheets.

Figure 14:
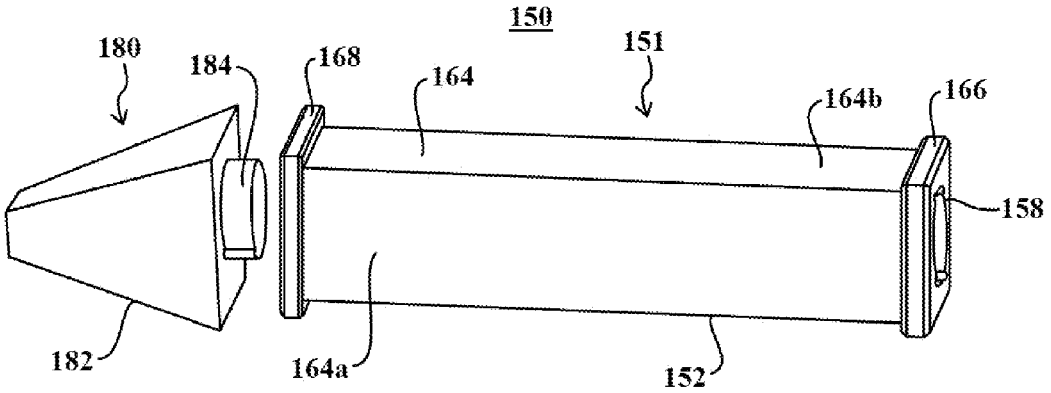
FIG. 14 is an exemplary perspective view of another embodiment of the core replacement tool of the invention.
Figure 15:
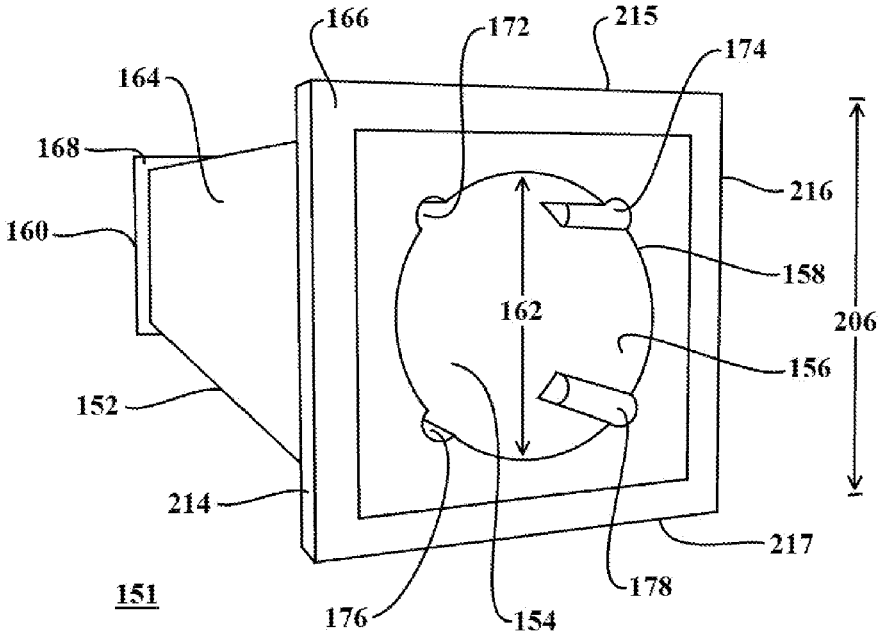
FIG. 15 is an end view of the replacement core apparatus shown in FIG. 14.

FIGS. 14-19 illustrate another exemplary embodiment of the core replacement tool 150 of the invention for mounting a coreless or tube-free roll of a flexible sheet material such as bathroom tissue or paper towels on a replacement core support apparatus 151 and a guide or insertion aid 180 which is used to gradually expand or open the center hole of the roll prior to inserting the replacement core apparatus 151 in such hole. Core apparatus 151 of tool 150 has an elongated body section 152 which is formed of a suitable material such as PVC plastic, wood, aluminum, metal, or other polymeric materials. As best shown in FIG. 15, body section 152 has a through-aperture 154 which is defined by a cylindrically shaped interior wall 156 that extends longitudinally between the open ends 158 and 160 of through-aperture 154. Inner diameter 162 of through-aperture 154 is sized to receive a paper roll spindle 20 (see FIG. 6) as well as other paper roll holding members. It should be evident that the external or outer surface 164 of body section 152 when viewed in cross section has a polygonal shape. In the exemplary embodiment, external surface 164 of body section 152, in contrast to the previously described embodiments, has a substantially square cross section and includes four rectangular outer surface sections, two of which 164*a* and 164*b* are visible in FIG. 14. In other exemplary embodiments external surface 164 may have other polygonal shapes such as a rectangular, pentagon, or hexagon shaped cross section or cross-sectional profile. In addition, core apparatus 151 is dimensioned such that body section 152 can be inserted or received in the usually compressed or mashed center opening or hole of a coreless roll of a flexible or pliable material in order to mount the roll on body section 152 of replacement core apparatus 151.

Replacement core apparatus 151 also includes a lip or enlarged section 166 and 168 adjacent both ends 158 and 160 of body section 152, respectively, which when a roll 10 is mounted on apparatus 151 aid in centering the roll on body section 152 and also hinder the roll from being easily removed from apparatus 151 from end 158 or 160. Enlarged sections 166 and 168 in the exemplary embodiment have a cross sectional profile or shape that is substantially the same as the cross sectional profile or shape of external surface 164 of body section 152 except that the dimensions of enlarged sections 166 and 168 are greater. In other embodiments, the shape of enlarged sections 166 and 168 may be different from the shape of external surface 164. As best shown in FIG. 15, interior wall 156 of through-aperture 154 of body section 152 includes a plurality of slots 172, 174, 176, and 178 adjacent open ends 158 and 160, which extend a predetermined distance into through-aperture 154 from ends 158 and 160, and as discussed below serve as guides for properly aligning and positioning guide or insertion aid 180 over either end 158 or 160 of roll support 151.

Figure 16:
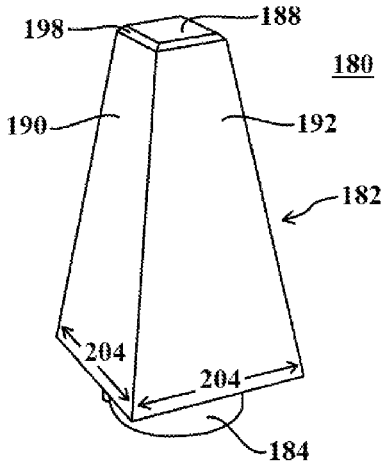
FIG. 16 is a side top view of the insertion aid shown in FIG. 14.
Figure 17:
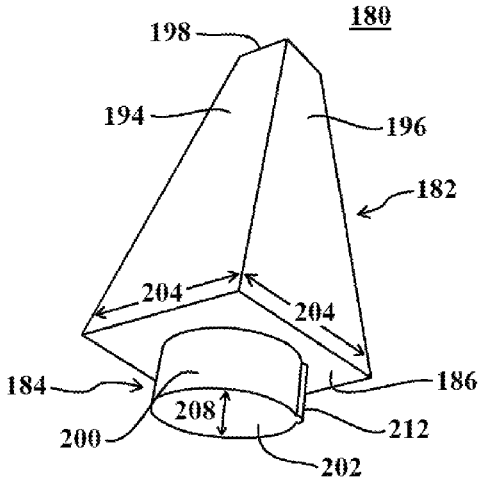
FIG. 17 is a side bottom view of the insertion aid shown in FIG. 16.

Guide or insertion aid 180 may be manufactured by machining, injection molding, or extrusion from a single piece of PVC plastic, wood, or other suitable material or combination of materials, or from two or more separate pieces that have been joined together by a permanent adhesive or other suitable means. As shown in FIGS. 16 and 17, guide or insertion aid 180 in the exemplary embodiment includes a tapered section 182 having a frustum or square pyramid shape and an attachment section 184 connected extending outwardly from an end of tapered section 182. More particularly, tapered section 182 has a lower surface 186, an end surface or insertion end 188, and a plurality of flat side surfaces 190, 192, 194, and 196, which surfaces are substantially smooth. The edges and corners 198 joining end surface 188 with side surfaces 190, 192, 194, and 196 are preferably rounded or chamfered. Tapered section 182 has a decreasing profile extending from lower surface 186 to end surface 188, giving the tapered section 182 a frustum shape.

Attachment section 184 in the exemplary embodiment has a cylindrical shape and extends outwardly from lower surface 186 of tapered section 182 in a direction opposite end surface 188, and includes a side surface 200 and a bottom surface 202. Lower surface or base 186 of tapered section 182 in the exemplary embodiment has a polygonal shape, and in the exemplary embedment the width 204 of each of side surfaces 190, 192, 194, and 196 at their point of connection with lower surface 186 is the same such that lower surface 186 is square. In addition, width 204 is at least equal to width 206 (see FIG. 15) of lip or enlarged sections 166 and 168 of roll support 151. Further, cylindrical attachment section 184 has a diameter 208 which is slightly less than inner diameter 162 of roll support 151 so that section 184 can be snugly fitted into end 158 or 160 of through-aperture 154. Also provided on side surface 200 of attachment section 184 is alignment tab 212, which is dimensioned to be snugly received in one of the slots 172, 174, 176 and 178 in side wall 156 of through-aperture 154 shown in FIG. 15 when the attachment section 184 is inserted into either end 158 or 160 of the replacement core support apparatus 151. More particularly, the position of tab or extension 212 on attachment section 184 of insertion aid 180 and slots 172, 174, 176, and 178 in core support 151 are defined such that when tab 212 is inserted into one of these slots, the side surfaces 190, 192, 194, and 196 of tapered section 182 of insertion aid 180 are automatically in alignment with side edges 214, 215, 216, and 217 of enlarged section 166 or 168. In other embodiments there may be a plurality of tabs 212 on attachment section 184 and a single slot or a plurality of slots in through-aperture 154.

Core apparatus 151 as illustrated is sized and adapted to support consumer sized rolls of bathroom tissue having conventional dimensions, which typically have a width of between about 3½ and 4 inches. As such, apparatus 151 in an exemplary embodiment has a width from end 158 to end 160 of between about 4 3/16 inches and 4½ inches, with body section 152 having a width of between about 3¾ inches and 4⅜ inches, and enlarged sections 166 and 168 having a width of about 1/16 inch. In addition, the external surface 164 of body section 152 has a width of about 1⅜ inches square, and enlarged sections 166 and 168 have a width 206 as measured from side edges 214, 215, 216, and 217 of about 1 9/16 inches square. Further, in the currently described exemplary embodiment, center hole or through-aperture 154 has a diameter 162 of between about 1 inch and about 1¼ inches round, and slots 172, 174, 176, and 178 are about 3/16 inches half round. Insertion aid 180 in the exemplary embodiment has a length from the end surface 188 of frustum shaped section 182 to bottom surface 202 of cylindrical section 184 about 3¼ inches, end surface 188 is about ½ inch square, side surfaces 190, 192, 194, and 196 are angled outwardly from top surface at about 15 degrees from the longitudinal center axis of tapered section 182 and have a width 204 of about 1½ inches, such that lower surface 186 is about 1½ inches square. Cylindrical section 184 has a diameter 208 of slightly less than the diameter 162 of through-aperture 154, or in the exemplary embodiment slightly less than between about 1 inch and about 1½ inches. In addition, extension 212 is slightly less than 3/16 inches half round. In another embodiment, core apparatus 151 is adapted to support rolls of household paper towels of a conventional width, and thus has a width from end 158 to end 160 of about 11 15/16 inches.

Figure 18:
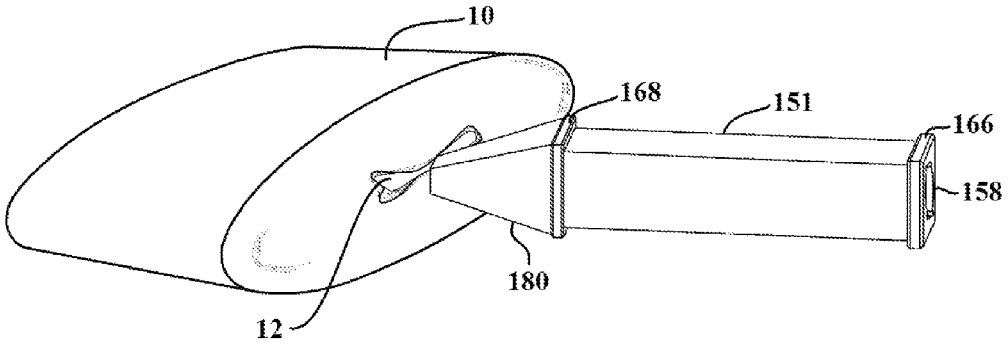
FIG. 18 illustrates the core replacement tool oriented for insertion into the center opening of a coreless roll.
Figure 19:
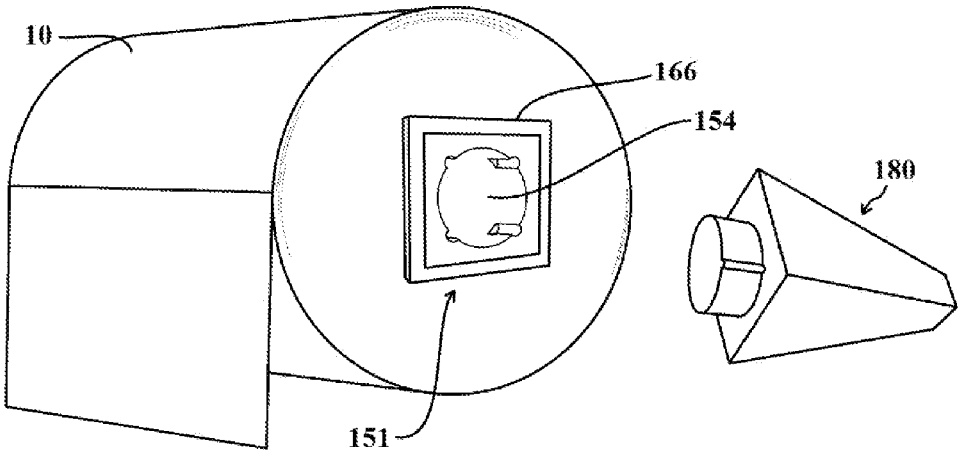
FIG. 19 illustrates a coreless roll mounted on the replacement core apparatus shown in FIG. 18.

In use, as shown in FIG. 18, guide or insertion aid 180 is positioned over an end 158 or 160 of reusable core apparatus 151 by inserting attachment section 184 of insertion aid 180 in end 158 or 160 of through-aperture 154 of apparatus 151, with tab or extension 212 being positioned as described above in one of the slots 172, 174, 176 or 178 such that end surface 188 of tapered section 182 is facing outwardly away from and is longitudinally aligned with apparatus 151. Once insertion aid 180 is properly secured over an end of apparatus 151, tool 150 and a coreless paper roll 10 may be held manually such that the top surface 188 of insertion aid 180 is directed into the mashed or compressed center hole 12 of roll 10. Insertion aid 180 and apparatus 151 are then manually forced further inwardly into center hole 12 twisting the aid 180 and apparatus 151 slightly as desired until insertion aid 180 has passed completely through center hole 12, and roll 10 is positioned over the external surface 164 of body section 152 of core replacement apparatus 151 between enlarged ends 166 and 168. As shown in FIG. 19, insertion aid 180 is then removed from over end 158 or 160 of apparatus 151, leaving roll 10 mounted on apparatus 151. A spindle 20 (see FIG. 6) of a paper holder device or other support may then be passed into through-aperture 154 in a usual manner.

Depending upon the particular manufacturer, the web material of coreless bathroom tissue rolls and paper towel rolls adapted for household use may be rolled more tightly or loosely, with the paper material of the more loosely packed rolls having the appearance at least of being a softer or fluffier product. Often, where the paper is more loosely rolled, although the center opening or hole must be large enough to be used with conventional spindles or holders in any event, the center opening or hole of the product may have slightly different dimensions. In general, the larger the center hole, the easier it is for consumers to mount the roll directly on a spindle. However, a drawback of a larger center opening is that the paper will tend to rotate or unroll on the spindle, rather than unrolling only when the spindle is rotated. In addition, as shown in FIG. 18, the center hole 12 of coreless paper rolls after having been mashed or crushed during packaging tends to take a noncircular shape.

Thus, providing the external surface 164 of body section 152 of replacement core apparatus 151 as well as the outer surface of tapered section 182 of insertion aid 180 with a polygonal shape as in the presently described embodiments has several advantages. One advantage is that the polygonal shape more closely matches the noncircular shape of the crushed or mashed center hole 12, and thus allows both the insertion aid 180 and core apparatus 151 to be more easily and quickly passed into the noncircular center hole 12 of a paper roll using only a manual force or pressure. In addition, the frustum shape of tapered section 182 of the insertion aid 180 aids in gradually expanding the center hole 12 to the required sized without tearing or damaging the paper material. Then, once the roll is mounted on body section 152, the polygonal shape of external surface 164 of apparatus 151 hinders roll 10 from rotating about such external surface 164, as the flexible paper material adjacent center hole 12 will tend to continually press inwardly against external surface 164 and conform to its polygonal shape.

Another significant advantage of the presently described embodiment is that insertion aid 180 is sized to fit over the end of lip or enlarged sections 166 and 168, which allows apparatus 151 to have enlarged sections 166 and 168 on both ends 158 and 160. This would not be possible with conventional rolls having a rigid cardboard core, since the rigid core would not flex far enough for the enlarged sections to pass through the center opening in the core. However, where rolls of a flexible or stretchable paper sheet material are not provided with a rigid center core, direct contact with the insertion aid causes the paper material to flex or stretch outwardly far enough for the enlarged end sections to pass through the center opening of the roll, after which the sheet material will move back to an unstretched orientation, whereby the paper material is now positioned between the end sections 166 and 168 and prevented from slipping off either end of the core replacement apparatus 151.

Figure 20:
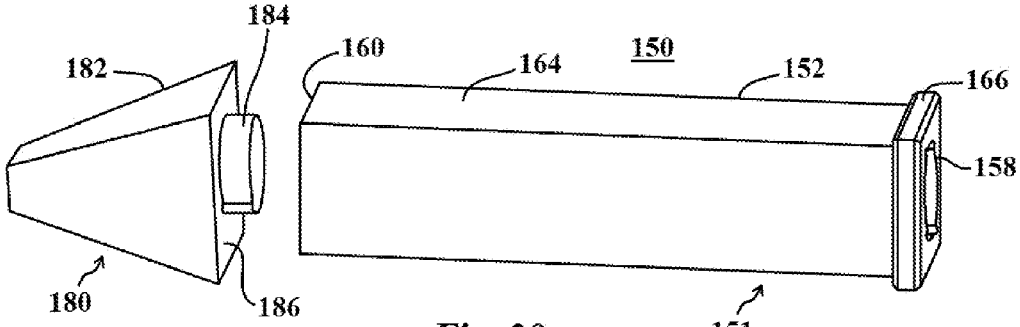
FIG. 20 illustrates the replacement core apparatus shown in FIG. 15 having an enlarged lip member on only one end.
Figure 21:
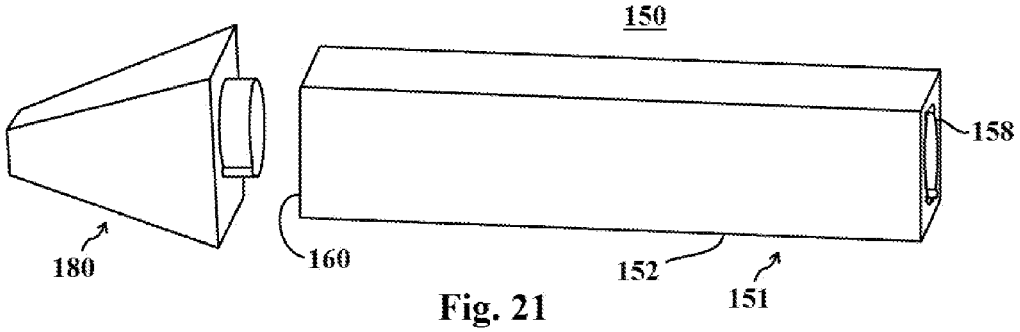
FIG. 21 illustrates the replacement core apparatus shown in FIG. 20 without an enlarged lip member.

In another exemplary embodiment shown in FIG. 20, core apparatus 151 has a lip or enlarged section 166 on end 158 of body section 152, but there is no lip on end 160 of body section 152. Nevertheless, insertion aid 180 can still be used to insert apparatus 151 into the center hole 12 of a coreless paper roll with end 160 of apparatus 151 facing inwardly, since base 186 of aid 180 has larger dimensions than body section 152 so that apparatus 151 will follow insertion aid 180 through and into center hole 12 without damaging or tearing the paper material. In another alternative embodiment, shown in FIG. 21, core replacement tool 150 does not have a lip or enlarged section on either end 158 or 160 of body section 152. However, it will be understand that insertion aid 180 in a manner similar to that described above with respect to FIG. 18 may still be positioned over either end 158 or 160 of body section 152 and passed into the center hole of a coreless paper roll in order to mount the paper roll on core apparatus 151. In another embodiment, one or both of the enlarged sections 166 and 168 may be detachable from body section 152.

FIGS. 22-25 illustrate another alternative embodiment of the core replacement tool 220 of the invention, which is similar to the previous embodiment in that it includes a replacement core apparatus 222 and an insertion aid 224 having a polygonal or frustum-shaped tapered section. Core apparatus 222 includes a body section 226 having a through-aperture 228 which is defined by a cylindrically shaped interior wall 230 extending longitudinally between open ends 232 and 234, and also having an inner diameter 236 sized to receive a paper roll spindle 20 (see FIG. 6) or other paper roll support. External surface 238 of body section 226 in the exemplary embodiment when viewed in cross section or from either end 232 or 234 has a cylindrical appearance or shape, and body section 226 is dimensioned so as to be capable of being inserted or received in the center hole of a coreless paper roll in order to mount the paper roll on the outer surface 238 of body section 226 of apparatus 222. Core apparatus 222 also has a lip or enlarged section 240 adjacent end 232, and another lip or enlarged section 242 adjacent end 234. As in the previously described embodiments, enlarged sections 240 and 242 have an outer diameter 243 which is greater than the diameter of external surface 238 in order to inhibit the paper roll from sliding off of or being easily removed from body section 226 from ends 232 and 234 once mounted on apparatus 222. In addition, enlarged sections 240 and 242 in the illustrated embodiment have a cross sectional profile that is substantially the same as the cross sectional profile of outer surface 238 of body section 226 except having larger dimensions as indicated above.

Figure 22:
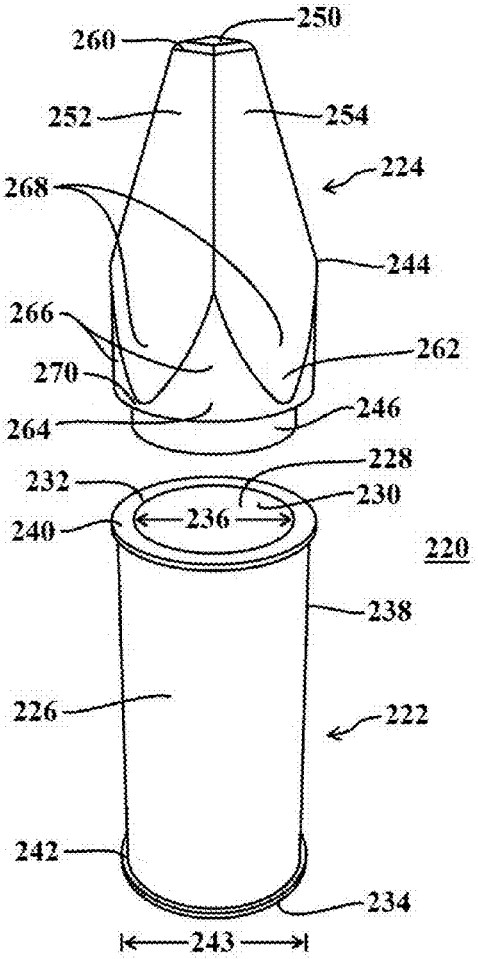
FIG. 22 is an isometric view of another exemplary embodiment of the core replacement tool of the invention.
Figure 23:
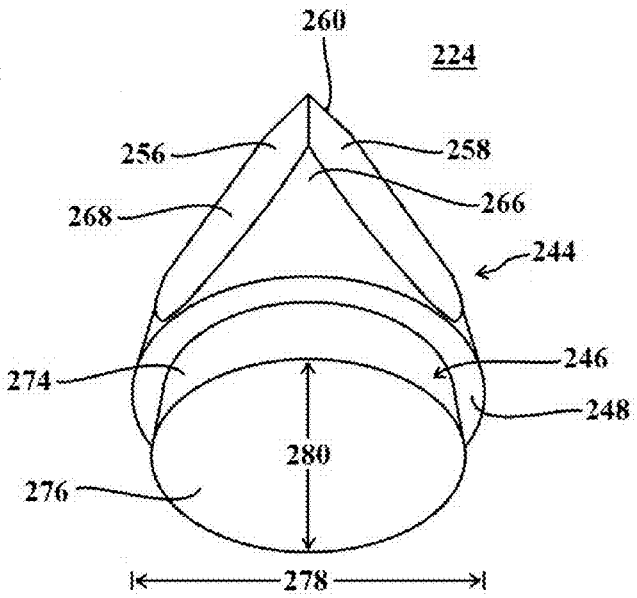
FIG. 23 is a bottom side view of the insertion aid shown in FIG. 22.

Guide or insertion aid 224 in the exemplary embodiment may be manufactured in a manner similar to the previously described embodiments, and generally includes a tapered section 244 and an attachment section 246 having a cylindrical shape and extending outwardly from one end of tapered section 244. More particularly, as best shown in FIGS. 22 and 23, tapered section 244 has a lower surface 248, a top surface 250, four adjacent flat side surfaces 252, 254, 256, and 258 each having a distal end 260 which connects with top surface 250 and a proximal end 262, and a rounded surface section 264 positioned between flat side surfaces 252, 254, 256, and 258 and attachment section 246. More particularly, the proximal end 262 of flat side surfaces 252, 254, 256, and 258 and rounded surface section 264 together give an area of tapered section 244 a crenulated pattern or appearance, which is formed by four generally triangularly shaped or merlon portions 266 of rounded surface section 264 alternating with four flat crenel portions 268 of side surfaces 252, 254, 256, and 258. Merlon portions 266 are connected to each other along the lower edge of rounded section 264 by narrow bridging sections 270, such that the proximal end 262 and lower surface or base 248 of tapered section 244 have a cylindrical shape or profile. Top or end surface 250 generally has a polygonal shape which in FIG. 22 is substantially square, and the edges and corners defining adjacent surfaces of tapered section 244 are preferably rounded or chamfered so that the entire outer surface of tapered section 244 is substantially smooth.

Cylindrical attachment section 246 extends outwardly from lower surface 248 of tapered section 244, and includes a side surface 274 and a bottom surface 276. The diameter 278 of lower surface 248 is large enough to be at least equal to and is preferably equal to the outer diameter 243 of enlarged sections 240 and 242 of core replacement apparatus 222. In addition, the diameter 280 of cylindrical attachment section 246 is slightly less than the inner diameter 236 of the through-aperture 228 of core apparatus 222 so that attachment section 246 fits snugly into either end 232 or 234 of through-aperture 228.

In one embodiment, core apparatus 222 is sized and adapted to support rolls of bathroom tissue typically having a width of between about 3½ and 4 inches. In an exemplary embodiment apparatus therefore has a width from end 232 to 234 of between about 4 inches and 4½ inches, with body section 226 having a width of between about 3¾ inches and 4⅜ inches, and enlarged sections 230 and 232 each having a width of about 1/16 inch. In addition, the outer surface 238 of body section 226 has a diameter of about 1¼ to 2⅛ inches, and enlarged sections 240 and 242 have an outer diameter of about 1 5/16 inches to 2¼ inches. Further, in the exemplary embodiment through-aperture 228 has an inner diameter 236 of between about 1 inch and about 2 inches round. Insertion aid 224 in the exemplary embodiment has a length from the top surface 250 of tapered section 244 to bottom surface 276 of cylindrical attachment section 246 of about 3½ inches, and tapered section 244 has a length from top surface 250 to lower surface 248 of about 3⅛ inches. Top surface 250 has a width of about ½ inch square, and side surfaces 252, 254, 256, and 258 are angled at between about 10 degrees and about 15 degrees with respect to the longitudinal center axis of tapered section 244. Lower surface 248 has a diameter 278 of between about 1 5/16 inches and about 2¼ inches, and bridging sections 270 connecting between merlon portions 266 of rounded section 264 at their narrowest point have a width of about 1/16 inch. Cylindrical attachment section 246 has a diameter 280 of slightly less than the diameter of through-aperture 228, or in the exemplary embodiment slightly less than between about 1 inch and about 2 inches, and side surface 274 has a width of about ⅜ inches. In another embodiment, core apparatus 222 is adapted to support a roll of household paper towels having a conventional width, and thus apparatus 222 has a width from end 232 to end 234 of about 11 15/16 inches.

In use, guide or insertion aid 224 of tool 220 is temporarily positioned over one of ends 232 and 234 of reusable core apparatus 222 by inserting attachment section 246 of insertion aid 224 into through-aperture 228 of apparatus 222, with tapered section 244 facing outwardly away from apparatus 222 and being longitudinally aligned with the longitudinal axis of apparatus 222 extending between ends 232 and 234. Once insertion aid 224 is properly positioned, tool 220 and a coreless paper roll 10 are held manually so that the top or outer surface 250 of tapered section 244 of insertion aid 224 can be directed into mashed or compressed center hole 12 of roll 10. Insertion aid 224 and core replacement apparatus 222 are then further manually forced inwardly into center hole 12 until insertion aid 224 has passed completely through center hole 12, and roll 10 is mounted on outer surface 238 of the core replacement apparatus 222 situated between enlarged ends 240 and 242. The insertion aid 224 is then manually removed from over end 232 or 234 of apparatus 222, leaving roll 10 mounted on apparatus 222. A spindle of a paper holder device or other support member may then be passed into through-aperture 228 of core replacement apparatus 222 in a conventional manner.

It has been found that providing a portion of the outer surface of tapered section 244 of guide or insertion aid 224 with a crenelated pattern adjacent to a frustum shaped section greatly facilitates insertion of core replacement apparatus 222 into the center hole 12 of a coreless paper roll. Initially, the polygonal or noncircular shape of top surface 250 and distal end 260 of side surfaces 252, 254, 256, and 258 more closely match the noncircular shape of a typical crushed or mashed center hole 12 of a coreless paper roll such as shown in FIGS. 1 and 2, thus making initial insertion of distal end 260 of insertion aid 224 into center hole 12 easier. In the presently described embodiment, however, the outer surface 238 of body section 226 of core apparatus 222 has a cylindrical shape, not a polygonal or noncircular shaped. Thus, the crenelated section of the insertion aid 224, which as indicated above is generally formed by alternating flat crenel portions 268 near proximal end 262 of flat side surfaces 252, 254, 256, and 258, and rounded triangular merlon portions 266, provides a transition area between a polygonal or noncircular area and a circular area of the tapered section 244 so that as the paper material adjacent the center hole 12 gradually contacts such surfaces allows the shape of center hole 12 to transition gradually and uniformly from a noncircular to a circular shape as apparatus 222 is inserted into the center hole 12 from one end. Tests have shown that the crenelated pattern adjacent the frustum shape further reduces damage and tearing of the innermost panels of the paper roll 10 adjacent center hole 12 as tool 220 is utilized to mount a paper roll on replacement core apparatus 222 in the manner described.

Figure 24:
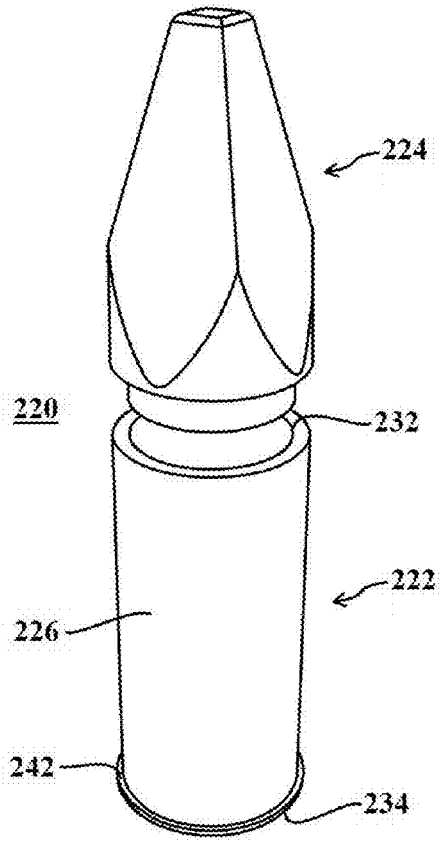
FIG. 24 illustrates the replacement core apparatus shown in FIG. 22 having an enlarged lip member on one end.
Figure 25:
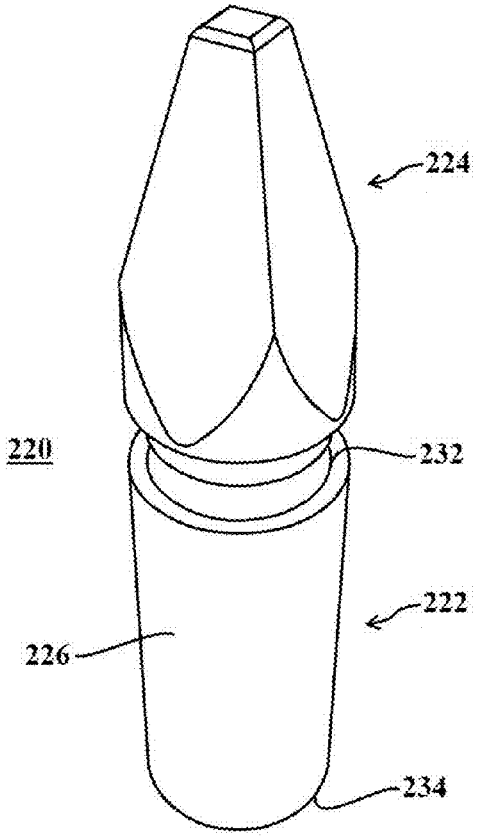
FIG. 25 illustrates the replacement core apparatus shown in FIG. 24 without a lip member.

In addition, the advantages of the embodiment shown in FIG. 14 are also provided in the present embodiment, in that insertion aid 224 is dimensioned so that the diameter of lower surface 248 of tapered section 244 is equal to or slightly greater than the diameter of lip or enlarged sections 240 and 242 adjacent the ends 232 and 234 of apparatus 222, respectively, which arrangement allows apparatus 222 to have enlarged sections on both ends while still enabling a paper roll to be easily mounted on apparatus 222. In another embodiment, shown in FIG. 24, core apparatus 222 has a lip or enlarged section 242 on end 234, but not on end 232. Nevertheless, insertion aid 224 can still be used as shown in FIG. 24 to insert apparatus 222 into the center hole 12 of a coreless paper roll with aid 224 over end 232, since the diameter 278 of lower surface 248 of tapered section 244 is equal to or greater than the outer diameter of body section 226 so that apparatus 222 will simply follow insertion aid 224 into center hole 12 without damaging or tearing the paper material. In another embodiment shown in FIG. 25, core replacement apparatus 222 does not have a lip or enlarged section on either end 232 or 234 of body section 226, but insertion aid 224 have the same dimensions as above can still be used alternatively with core replacement devices having a lip or no lip. In another embodiment, the enlarged sections may be detachable from body section 226 such as by a snap fit over the outer surface of the core replacement devices.

Figure 26:
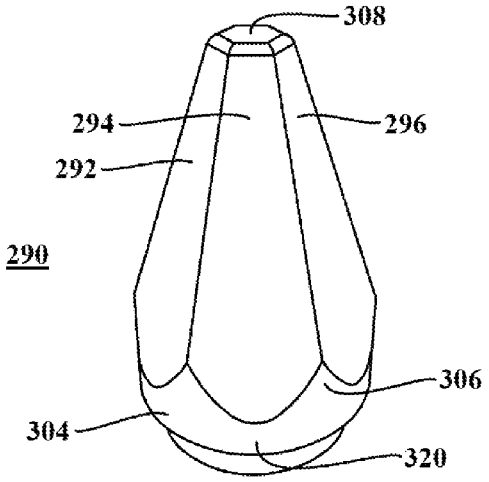
FIG. 26 is an isometric view of another embodiment of the insertion aid.
Figure 27:
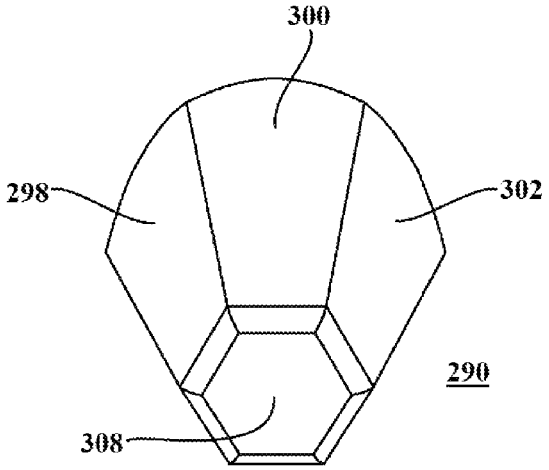
FIG. 27 is a top side view of the insertion aid shown in FIG. 26.
Figure 28:
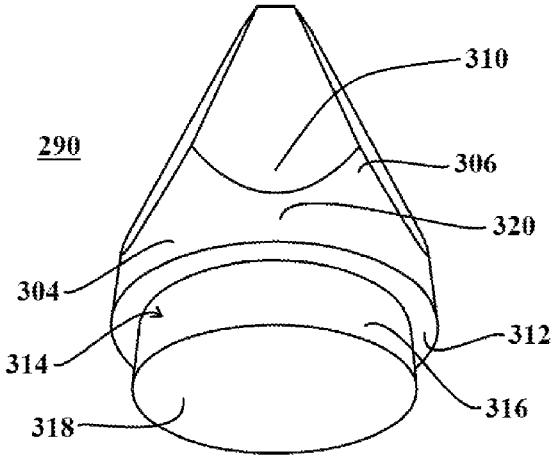
FIG. 28 is a bottom side view of the insertion aid shown in FIGS. 26 and 27.

FIGS. 26-28 illustrate another alternative embodiment of the insertion aid of the present invention, which is similar to insertion aid 224 illustrated in FIGS. 22-25 in its appearance and manner of use, except insertion aid 290 in FIGS. 26-28 although it also has a polygonal or frustum shaped section, it is a hexagon shape rather than a square shape. More particularly, insertion aid 290 has six flat side surfaces 292, 294, 296, 298, 300, and 302, and rounded section 304 near its lower end includes six triangular or merlon portions 306 interspaced between flat crenel portions 310 on the lower ends of flat side surfaces 292, 294, 296, 298, 300, and 302. Top surface 308 also has a hexagon shape, while lower surface 312 and attachment section 314 including side section 316 and bottom section 318 have similar dimensions to the previously described embodiment shown in FIGS. 22-25. It will be understood that as a result of the larger number of side surfaces and merlon portions provided in insertion aid 290, each of these side surfaces and triangular sections has a smaller overall surface area than in the embodiment illustrated in FIGS. 22-25. In addition, bridging sections 320 joining between merlon portions 306 have a width at their narrowest point in the exemplary embodiment of about 3/16 inches. It will be understood that the insertion aid may have a different number of crenel and merlon portions while still having a generally polygonal or frustum-shaped outer end that transitions to a rounded shape towards the lower surface of the insertion aid via a crenulated area while still falling within the intended scope of the invention.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A tool for mounting a coreless roll of flexible sheet material on a replacement core comprising:

(a) a reusable core apparatus including an elongated body section having opposite ends, an external surface having an polygonal shape and dimensioned to be received in a center opening of the roll of flexible sheet material, and a through-aperture defined by an interior wall extending longitudinally through said body section, said through-aperture having an interior diameter sized to receive a roll holder; and (b) an insertion aid including a tapered section and an attachment section for aligning the insertion aid over an end of the reusable core apparatus;

(c) said tapered section having an end surface, a lower surface spaced apart from said end surface, and a decreasing profile from the lower surface to the end surface, at least a portion of the tapered section having a frustum shape, and the lower surface having the same shape and the same or greater dimensions as the external surface of an end of said body section.

2. A tool in accordance with claim 1 in which the external surface of the reusable core apparatus has a square cross-section.

3. A tool in accordance with claim 1 in which the end surface of the insertion aid has a polygonal shape.

4. A tool in accordance with claim 3 additionally comprising an alignment aid for aligning the lower surface of the tapered section with an end of the reusable core apparatus such that the polygonal sides of the lower surface of the tapered section are aligned with the polygonal sides of the outer surface of the reusable core apparatus.

5. A tool in accordance with claim 4 in which said alignment aid comprises a first portion located in an end of the central aperture of said reusable core apparatus and a second portion located on the attachment section of said alignment aid, whereby when the attachment section is inserted into an end of the central aperture the polygonal outer surfaces of the reusable core apparatus and tapered section are in alignment.

6. A tool in accordance with claim 5 in which said alignment aid comprises at least one slot extending inwardly from an end of said through-aperture side wall and at least one tab member in the attachment provided section of the insertion aid.

7. A tool in accordance with claim 6 in which the attachment section has a cylindrical shape and a diameter that is slightly less than the interior diameter of the reusable core apparatus.

8. A tool in accordance with claim 1 additionally comprising a lip located adjacent an end of the reusable core apparatus, said lip having a shape that matches the shape of the base of the insertion aid, and the dimensions of the lower surface of the tapered section are at least as great as the dimensions of the at least one enlarged lip portion.

9. A tool in accordance with claim 8 additionally comprising a lip on both ends of the reusable core apparatus.

10. A tool for mounting a coreless roll of flexible sheet material on a replacement core comprising:

a reusable core apparatus including an elongated body section having opposite ends, an external surface dimensioned to be received in a center opening of the roll of flexible sheet material and having a cylindrical shape, and a through-aperture defined by an interior wall extending longitudinally through said body section, said through-aperture having an interior diameter sized to receive a roll holder; and an insertion aid including a tapered section and an attachment section for aligning the insertion aid over an end of the reusable core apparatus;

said tapered section having an end surface, a lower surface spaced apart from said end surface, and an outer surface with a decreasing profile from the lower surface to the end surface, at least a portion of the tapered section having a frustum shape and a crenulated pattern between the frustum shaped portion and the lower surface, said crenulated area having alternating crenel and merlon portions forming a gradual transition on the outer surface of the tapered section between a polygonal and nonpolygonal shape, and the lower surface having the same shape and the same or greater dimensions as the external surface of an end of said body section.

11. A tool in accordance with claim 10 additionally comprising a lip located adjacent an end of the reusable core apparatus, said lip having a shape that matches the shape of the insertion aid lower surface, and the dimensions of the lower surface are at least as great as the dimensions of the at least one lip.

12. A tool in accordance with claim 11 additionally comprising a lip on both ends of the reusable core apparatus.

13. A tool in accordance with claim 10 in which the tapered section of the insertion aid has four flat side surfaces.

14. A tool in accordance with claim 10 in which the tapered section of the insertion aid has six flat side surfaces.

* * * * *